US006834166B2

(12) United States Patent
Fujikura

(10) Patent No.: US 6,834,166 B2
(45) Date of Patent: Dec. 21, 2004

(54) IMAGE FORMING APPARATUS WITH IMAGE DISTANCE INTERVAL CONTROLLER

(75) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/335,358

(22) Filed: Dec. 31, 2002

(65) Prior Publication Data

US 2004/0042803 A1 Mar. 4, 2004

(30) Foreign Application Priority Data

Aug. 29, 2002 (JP) ..... 2002-251838

(51) Int. Cl.[7] ..... G03G 15/00
(52) U.S. Cl. ..... 399/23; 399/394; 399/396
(58) Field of Search ..... 399/16, 23, 43, 399/45, 388, 389, 393, 394, 396; 271/256, 259, 258.01

(56) References Cited

U.S. PATENT DOCUMENTS 5,966,555 A * 10/1999 Nakajima et al. ..... 399/23 X
6,493,518 B2 * 12/2002 Park ..... 399/23
6,567,620 B2 * 5/2003 Brown et al. ..... 399/23 X

* cited by examiner

*Primary Examiner*—William J. Royer
(74) *Attorney, Agent, or Firm*—Akin Gump Strauss Hauer & Feld, L.L.P.

(57) ABSTRACT

An image forming section forms images, which are transferred onto a primary medium. A medium cassette holds a stack of print medium. A remaining-medium detector detects the number of pages of remaining print medium held in the medium cassette. The image on the primary medium are transferred onto a print medium fed from the medium cassette. A controller changes a timing at which the image forming section forms the images, the timing being changed in accordance with the number of pages of remaining print medium. The timing is changed in such a way that the images are formed at greater distance intervals on the primary medium when the number of pages of the medium cassette in the medium cassette is equal to or less than a reference value than when the number of pages of the medium cassette in the medium cassette is more than the reference value.

29 Claims, 17 Drawing Sheets

IMAGE FORMING APPARATUS WITH IMAGE DISTANCE INTERVAL CONTROLLER

BACKGROUND OF THE INVENTION

1. Field of the Invention

The present invention relates to an image recording apparatus.

2. Description of the Related Art

A conventional color image recording apparatus such as a printer, a copying machine, and a facsimile machine is equipped with print engines for yellow, magenta, cyan, and black, an intermediate transfer belt, LED heads, a primary transfer roller, a secondary transfer roller, and a fixing unit. The intermediate transfer belt runs along a row of the print engines. The LED heads are provided to corresponding print engines so that each LED head illuminates the surface of a photoconductive drum of a corresponding print engine to form an electrostatic latent image on the surface. The primary transfer roller is disposed with the intermediate transfer belt between the primary transfer roller and the respective print engines, so that color toner images on the respective photoconductive drums are transferred onto the intermediate transfer belt in registry. The secondary transfer roller transfers the toner images on the intermediate transfer belt onto a print medium such as paper or OHP sheet. The fixing unit fixes the color toner images on the print medium.

However, with the aforementioned conventional image recording apparatus, pages of print medium advanced to the print engines are very closely spaced, thereby increasing the throughput in each printing operation. The toner images are formed on the intermediate transfer belt at predetermined intervals in accordance with the spacing of the print medium. If the pages of print medium cannot be advanced in succession, e.g., when the print medium is jammed or paper cassettes run out of print medium, the toner images formed of one or more colored toners remain left on the intermediate transfer belt. Therefore, the toner images remaining on the intermediate transfer belt have to be removed before printing is resumed after the paper cassettes are replenished with print medium, and then the same toner images have to be formed again on the intermediate transfer belt. This implies that toner images previously formed on the intermediate transfer belt but not transferred onto a print medium are wasted.

Moreover, when a paper cassette runs out of print medium in the middle of a printing job, print medium should be fed from another paper cassette that holds print medium of the same size. However, the print medium may not be accurately positioned relative to the toner image on the intermediate transfer belt due to the fact that the print medium has to travel through a transport path of a somewhat different length. Thus, the toner images formed on the intermediate transfer belt have to be removed and new toner images have to be formed on the intermediate transfer belt. This also results in waste of toner.

SUMMARY OF THE INVENTION

The present invention was made to solve the aforementioned problems and an object of the invention is to provide an image recording apparatus that reduces waste of toner.

An image forming section forms images, which are transferred by a transfer section onto a primary medium from the image forming section. A medium cassette holds a stack of print medium. A remaining-medium detector detects the number of pages of remaining print medium held in the medium cassette. The images on the primary medium are transferred onto a print medium fed from the medium cassette. A controller changes a timing at which the image forming section forms the images, the timing being changed in accordance with the number of pages of remaining print medium.

The controller causes the image forming section to form the images at first timings when the medium cassette holds pages of the print medium of more than a reference value. The controller causes the image forming section to form the images at second timing when the medium cassette holds pages of the print medium equal to or less than the reference value. The second timings are delayed relative to the first timings so that the images are formed at greater distance intervals on the primary medium when the images are formed at the second timings than when the images are formed at the first timings.

The controller changes the timing when the medium cassette holds pages of the print medium of equal to or less than a reference value. The timing is changed after the controller determines that the medium cassette holds at least one page of print medium.

The medium cassette is one of a plurality of medium cassettes each of which has the remaining-medium detector. When a first medium cassette of the plurality of medium cassettes holds pages of the print medium more than a reference value during a printing job, the controller feeds the pages of the print medium from the first medium cassette to the transfer section. When the first medium cassette becomes empty of the print medium in the middle of the printing job, the controller feeds the print medium from a second medium cassette of the plurality of medium cassettes to the transfer section instead of the first medium cassette. The second medium cassette holds a stack of print medium therein.

The controller causes the image forming section to form the images at first distance intervals when the print medium is fed from the first medium cassette that holds pages of the print medium of more than the reference value. The controller causes the image forming section to form an image in such a way that an image for a final page fed from the first medium cassette and the image for the first page fed from the second medium cassette are spaced apart by a second distance interval. The second distance interval is longer than the first distance interval. The controller causes the image forming section to form the images at the first distance intervals when the controller feeds pages of the print medium from the second medium cassette after the first page of the stack of print medium is fed from the second medium cassette.

The first medium cassette holds pages of first print medium having a first size and the second medium cassette holds pages of second print medium having a second size, the first size being smaller than the second size.

The controller causes the image forming section to form the images at different distance intervals in accordance with the number of pages of print medium that remains in the medium cassette.

The controller causes the image forming section to form the images at first distance intervals when the medium cassette holds pages of the print medium more than a reference value. The controller causes the image forming section to form the images at second distance intervals when the medium cassette holds pages of the print medium equal to or less than the reference value, the second distance intervals being longer than the first distance intervals.

The controller causes the image forming section to form the images at distance intervals longer than a difference between a first distance from the image forming section to a secondary medium and a second distance from the medium cassette to the secondary medium.

The medium cassette is one of a plurality of medium cassettes each of which has the remaining-medium detector. When a first medium cassette holds pages of the print medium of more than a reference value, the controller feeds the print medium from the first medium cassette. When the number of pages of the print medium in the first medium cassette decreases below the reference value in the middle of a printing job, the controller feeds the print medium from the second medium cassette. When the controller feeds the print medium from the second medium cassette instead of from the first medium cassette, the controller causes the image forming section to form images at different distance intervals. The distance interval is changed in accordance with a difference in medium transport path between when the print medium is fed from the first medium cassette and when the print medium is fed from the second medium cassette.

The controller causes the image forming section to form the images at first distance intervals when the controller feeds pages of the print medium from the first medium cassette and the first medium cassette holds the print medium of more than the reference value. The controller causes the image forming section to form an image in such a way that an image for a final page fed from the first medium cassette and the image for the first page fed from the second medium cassette are spaced apart by a second distance interval. The second distance interval is longer than the first distance interval, Further, the controller causes the image forming section to form the images at the first distance interval when the controller feeds pages of the print medium from the second medium cassette after the first page of the stack of print medium is fed from the second medium cassette.

The first medium cassette holds pages of first print medium having a first size and the second medium cassette holds pages of second print medium having a second size, the second size being larger than the first size.

The image forming section is one of a plurality of image forming sections, the plurality of image forming sections forming images in registration with one another.

The controller causes the image forming sections to form the images at distance intervals larger than a difference between a first distance and a second distance. The first distance is a distance from an image forming section most upstream in a transport path of the primary medium to the transfer section. The second distance is a distance from the medium cassette to the transfer section.

The image forming sections are arranged to configure a tandem type image recording apparatus.

The image recording apparatus further comprises a display that indicates that the number of pages in the medium cassette is less than a reference value.

The primary medium is a transfer belt.

The primary medium is a transfer drum.

The medium cassette includes a medium-holding member that holds the stack of the print medium thereon and takes up a different position in accordance with the number of pages of the print medium remaining in the medium cassette. The detector detects the number of pages of the print medium held in the medium cassette in terms of a position of the medium-holding member.

The medium-holding member has a reflective member, so that the detector detects the number of pages of the print medium held in the medium cassette in terms of a position of the medium-holding member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings. While the image recording apparatus according to the present invention will be described with respect to a printer by way of example, the present invention may of course be applied to other apparatus such as a copying machine and a facsimile machine.

First Embodiment

{Construction}

Figure 1:
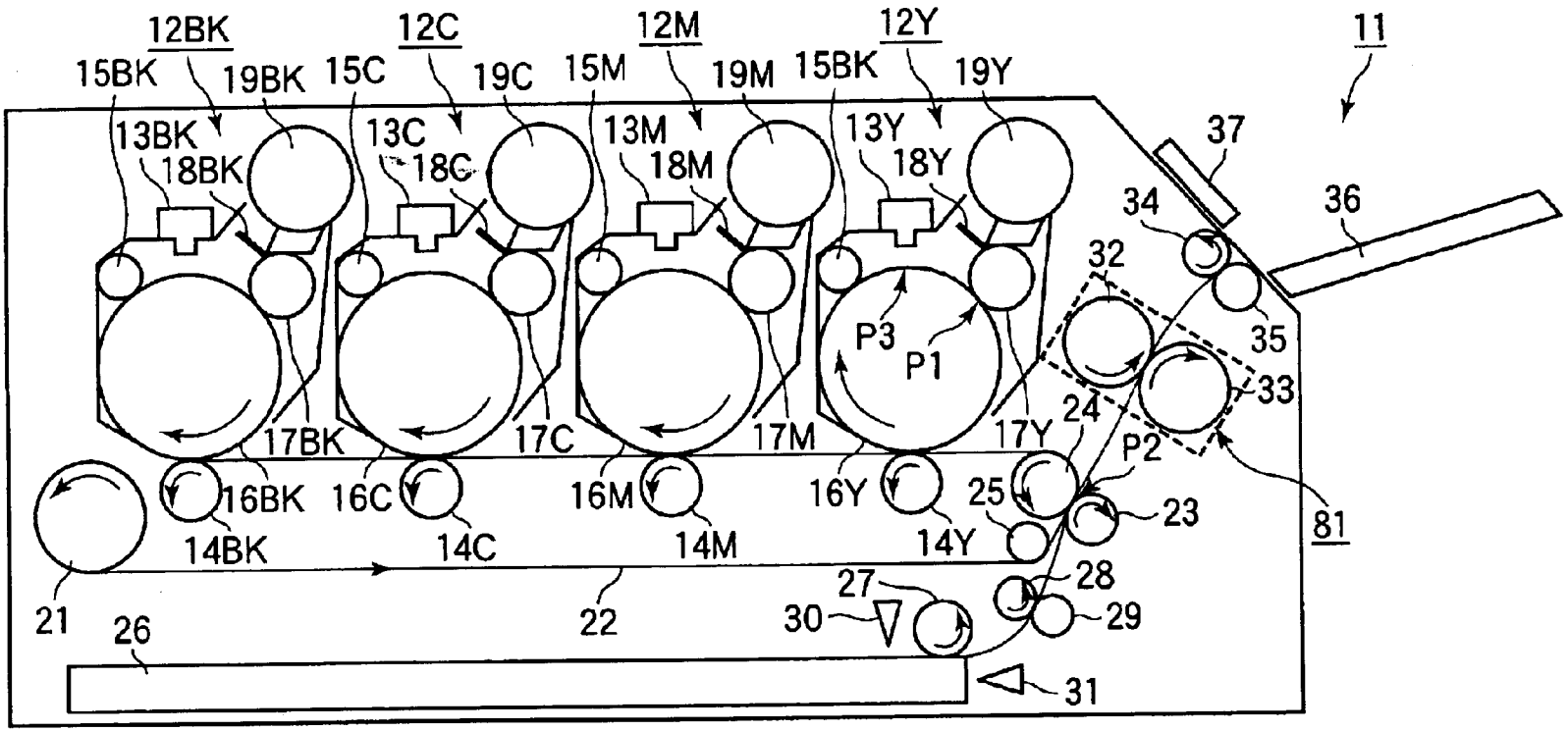
FIG. 1 illustrates the general configuration of a printer according to a first embodiment of the present invention.

FIG. 1 illustrates the general configuration of a printer according to a first embodiment of the present invention.

Referring to FIG. 1, a printer 11 is a tandem type printer that includes print engines 12Y, 12M, 12C, and 12BK for yellow, magenta, cyan, and black images, respectively. LED heads 13Y, 13M, 13C, and 13BK illuminate photoconductive drums 16Y, 16M, 16C, and 16BK in the corresponding print engines 12Y, 12M, 12G, and 12BK to form electrostatic latent images of the corresponding colors. Primary transfer rollers 14Y, 14M, 14C, and 14BK oppose the photoconductive drums 16Y, 16M, 16G, and 16BK of the corresponding print engines 12Y, 12M, 12G, and 12BK. An intermediate transfer belt 22 is sandwiched between the primary transfer rollers 14Y, 14M, 14C, and 14BK and the photoconductive drums 16Y, 16M, 16C, and 16BK. The intermediate transfer belt 22 runs through the respective print engines 12Y, 12M, 12G, and 12BK so that toner images of respective colors are formed in registration with one another into a full color toner image. The full color toner images are formed at predetermined intervals on the intermediate transfer belt 22. A secondary transfer roller 24 rotates in contact with the intermediate transfer belt 22, and a print medium such as print paper and transparency travels between the secondary transfer roller 24 and a backup roller 23, so that the images of the respective colors are transferred onto the print medium. The print medium is advanced to a fixing unit 81 that fixes the full color toner image on the print medium into a permanent full color image. An intermediate transfer drum may be used in place of the intermediate transfer belt 22.

The print engines 12Y, 12M, 12C, and 12BK include toner bottles 19Y, 19M, 19C, and 19BK, developing rollers 17Y, 17M, 17C, and 17BK, and the photoconductive drums 16Y, 16M, 16C, and 16BK. The developing rollers 17Y, 17M, 17C, and 17BK supply colored toners to the corresponding photoconductive drums 16Y, 16M, 16C, and 16BK. Developing blades 18Y, 18M, 18C, and 18BK form thin layers of toner on the corresponding developing rollers 17Y, 17M, 17C, and 17BK. Charging rollers 15Y, 15M, 15C, and 15BK uniformly charge the surfaces of the photoconductive drums 16Y, 16M, 16C, and 16Bk, respectively.

The intermediate transfer belt 22 is entrained about a drive roller 21, the secondary transfer roller 24, and an idle roller 25, which are driven in rotation when a belt motor, not shown, drives the drive roller 21. The drive roller 21 and the secondary transfer roller 24 are spaced apart by a predetermined distance, so that the intermediate transfer belt 22 runs through the print engines 12Y, 12M, 12C, and 12BK. The intermediate transfer belt 22 is sandwiched between the secondary transfer roller 24 and the backup roller 23.

A paper cassette 26 holds a stack of print medium therein. A hopping roller 27 is disposed close to the paper cassette 26 and driven by a hopping motor, not shown, to feed the print medium from the paper cassette 26 on a page-by-page basis to a registry roller 28. The registry roller 28 is in pressure contact with a backup roller 29 and is driven in rotation by a registry motor, not shown, to feed each page of the print medium to the secondary transfer roller 24 at a predetermined timing. A discharge roller 34 cooperates with a backup roller 35 to discharge the printed print medium out of the printer 11 onto a stacker 36 on which printed pages are stacked.

The fixing unit 81 includes a heat roller 32 and a backup roller 33 that is urged by a spring, not shown, against the heat roller 32. The heat roller 32 is driven in rotation by a heater motor, not shown, and the backup roller 33 rotates in pressure contact with the heat roller 32.

A medium sensor 30 detects the presence and absence of the print medium in the paper cassette 26. A sensor 31 detects the print medium remaining in the paper cassette 26. A display panel 37 takes the form of, for example, a liquid crystal display and displays the operating states of the printer 11 to indicate the operation (e.g., remaining print medium in the paper cassette 26) of the printer 11 to the user.

{Operation of Controller}

Figure 2:
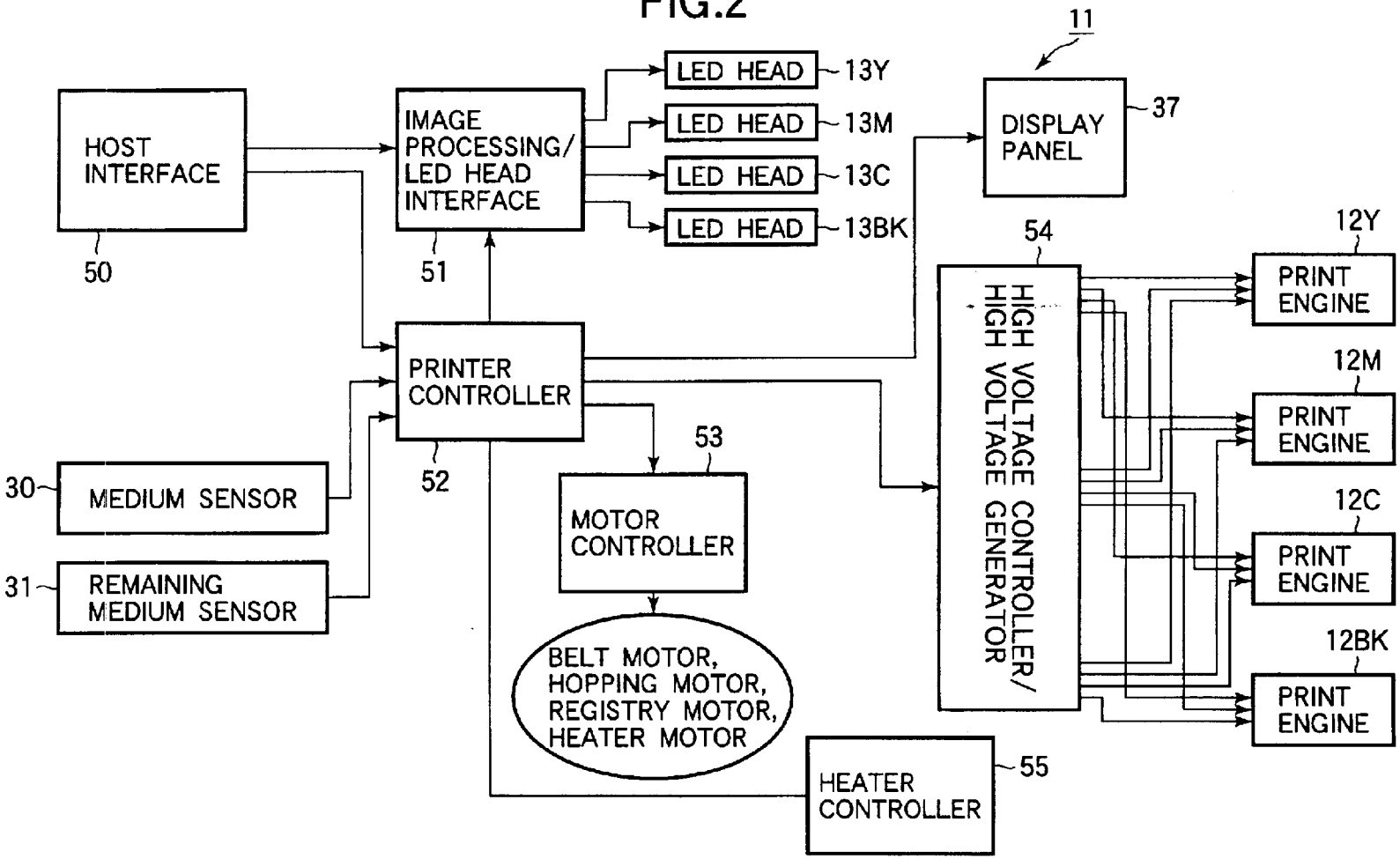
FIG. 2 is a block diagram of the printer according to the first embodiment.

FIG. 2 is a block diagram of the printer 11 according to the first embodiment;

A control circuit of the aforementioned printer 11 will be described with reference to FIG. 2. Referring to FIG. 2, a host interface 50 receives print data from a host computer, the print data including image information such as computer language for describing images. An image processing/LED head interface 51 converts the print data into image data that can drive the LED heads 13Y, 13M, 13C, and 13BK. The image processing/LED head interface 51 also interprets the language received from the host computer. A motor controller 53 controls various motors including the belt motor, hopping motor, registry motor, and heater motor. A high voltage controller/high voltage generator 54 supplies high voltages of about 1 to 2 kV to the charging rollers 15Y, 15M, 15C, and 15BK, primary transfer rollers 14Y, 14M, 14C, and 14BK, and secondary transfer roller 24. The heater controller 55 controls the on-and-off operation of the heater built in the heat roller 32. A printer controller 52 includes a Cpu or MPU and a ROM that stores various control data and the control programs, and functions as a computer under the control programs and data.

The printer 11 also includes the medium sensor 30, remaining medium sensor 31, and display panel 37.

{Operation for Detecting Remaining Medium}

Figure 3:
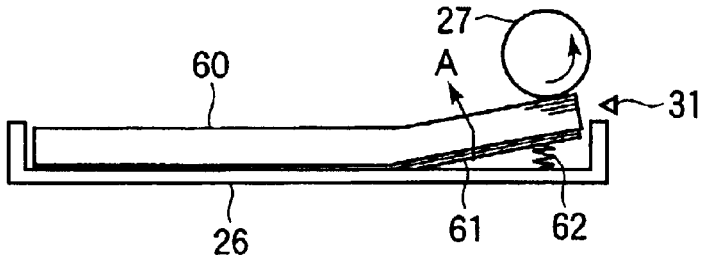
FIG. 3 illustrates a pertinent portion of the paper cassette according to the first embodiment of the invention.

FIG. 3 illustrates a pertinent portion of the paper cassette 26 according to the first embodiment of the invention.

The operation for detecting the remaining medium in the paper cassette 26 will be described with reference to FIG. 3. Referring to FIG. 3, the paper cassette 26 includes a hopping plate 61 and a spring 62. The hopping plate 61 is pivotally assembled to the bottom of the paper cassette 26. The spring 62 urges the hopping plate 61 upward so that the hopping roller 27 is in pressure contact with the top page of a stack of print medium 60 held in the paper cassette 26. Alternatively, the stack of print medium 60 may be urged against the hopping roller 27 by means of a drive force of a motor, not shown.

As color images are printed on pages on the print medium 60 in succession, the number of pages of print medium 60 held in the paper cassette 26 decreases. As a result, the hopping plate 61 pivots gradually in a direction shown by arrow A, so that the free end of the hopping plate 61 rises higher gradually. When the free end of the hopping plate 61 reaches a predetermined height, a remaining medium sensor 31 (FIGS. 3A and 3B) detects that the remaining pages of the medium 60 is, for example, 10 pages. The remaining medium sensor 31 takes the form of, for example, a photo sensor, a micro switch, or the like.

Figure 4A:
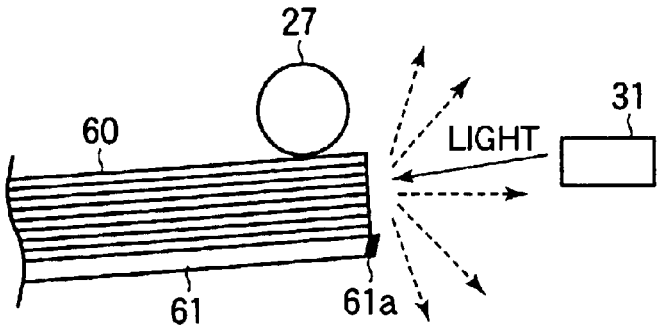
FIGS. 4A–4F illustrate the positional relationship between the remaining medium sensor and the stack of print medium.
Figure 4B:
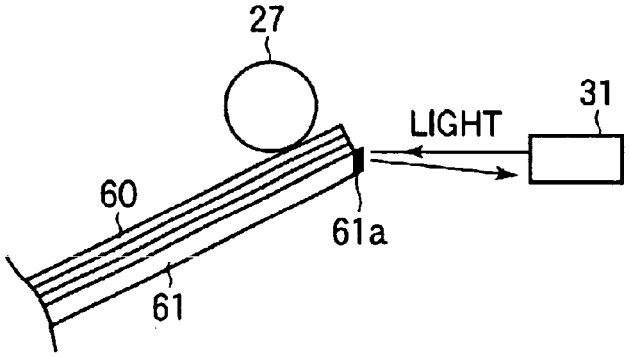
Figure 4C:
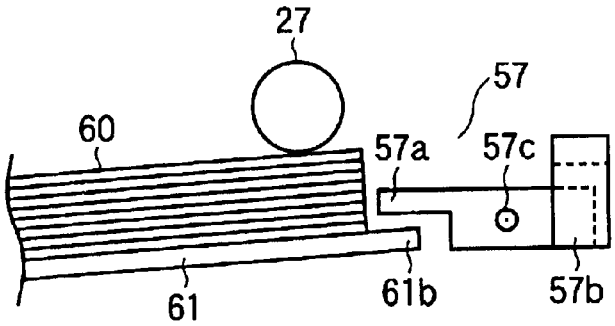
Figure 4D:
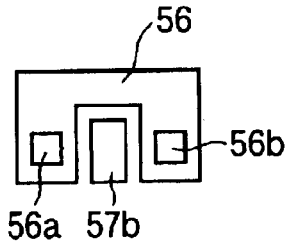
Figure 4E:
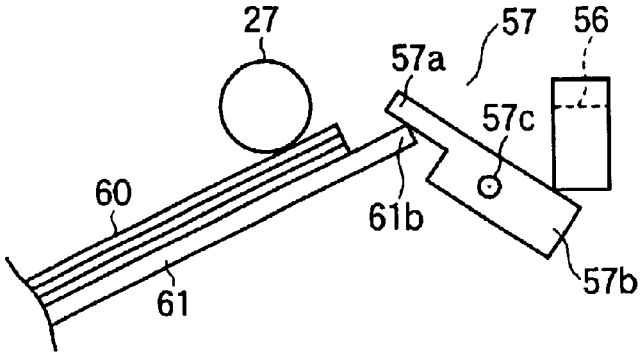
Figure 4F:
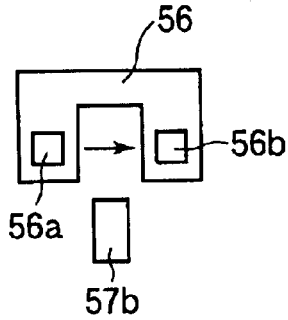

FIGS. 4A and 4B illustrate the positional relationship between the remaining medium sensor 31 and the stack of print medium 60. As shown in FIGS. 4A and 4B, the hopping plate 61 has a reflective member or reflector 61*a* attached to a portion of the printer 11 that opposes the medium sensor 31. Referring to FIG. 4A, when the paper cassette 26 holds a large number of pages of print medium 60, the light emitted from the medium sensor 31 impinges the stack and a very little amount of light returns to the medium sensor 31 due to diffuse reflection. Referring to FIG. 4B, when the paper cassette 26 holds a small number of pages of print medium 60, the free end of hopping plate 61 is raised by the spring 62. Therefore, almost 100% of the light emitted from the medium sensor 31 is reflected by a reflector 61*a* back to the medium sensor 31.

If the medium sensor 31 fails to accurately indicate the remaining 10 pages, the medium sensor 31 may be moved to such a location that the sensor output changes appreciably when the number of remaining pages reaches, for example, 50. Then, it can be determined that the number of remaining pages is 10 when the remaining pages has been counted up to 40 after the medium sensor 31 has detected the remaining number of pages of 50. This way of detecting the number of remaining pages absorbs variations of the sensitivity or inaccuracy of the medium sensor 31 and the amount of pivotal movement of the hopping plate 61.

FIGS. 4C–4F illustrate another remaining medium detector. When the hopping plate 61 holds a large number of pages of print medium 60, a rocking bar 57 is oriented horizontally about a pivot 57*c* so that a first end portion 57*b* blocks the light path of a photo detector 56. When the hopping plate 61 supports a small number of pages of print medium 60, a second end portion 57*a* of the rocking bar 57 is pushed up by an end portion 61*b* of the hopping plate 61 to be oriented upwardly so that the second end portion 57*b* un-blocks the light path of the photo detector 56, allowing light to pass between the emitter 56*a* and receiver 56*b* of the photo detector 56.

{Operation of Printer}

The operation of the printer 11 of the aforementioned configuration will now be described.

Upon receiving print data from a host computer, not shown, an image processing/LED head interface 51 receives the print data via the host interface 50 (FIG. 2) and converts the print data into image data that can drive LED heads 13Y, 13M, 13C, and 13BK.

When print data for one page has been converted into corresponding image data, the printer controller 52 performs a necessary preparatory processing before activating a printing operation.

Upon activation of a printing operation, the hopping roller 27 feeds the print medium 60 one page at a time from the paper cassette 26 to the registry roller 28, which in turn advances the print medium 60 further to the print engine 12Y.

At the print engine 12Y, the charging roller 15Y charges the surface of the photoconductive drum 16Y The LED head 13Y illuminates the charged surface of the photoconductive drum 16Y to selectively dissipate the charges on the photoconductive drum 16Y, thereby forming an electrostatic latent image. A certain, amount of yellow toner in the toner bottle 19Y is supplied to the developing roller 17Y The developing blade 18Y on the developing roller 17Y charges the yellow toner triboelectrically. Then, the charged yellow toner is attracted electrostatically to the photoconductive drum 16Y, thereby developing the electrostatic latent image on the photoconductive drum 16Y into a yellow toner image. Likewise, the print engines 12M, 12C, and 12BK form magenta, cyan, and black toner images, respectively.

When the intermediate transfer belt 22 runs through primary transfer stations defined by the print engines 12Y, 12M, 12G, and 12BK and primary transfer rollers 14Y, 14M, 14C, and 14BK, so that the yellow, magenta, cyan, and black toner images are transferred onto the intermediate transfer belt 22 in sequence. For this purpose, the primary transfer rollers 14Y, 14M, 14C, and 14BK receive voltages having a polarity opposite to that of the charged toner from a high voltage controller/high voltage generator 54.

In this manner, yellow, magenta, cyan, and black toner images are transferred onto the intermediate transfer belt 22 in register, thereby forming a full color toner image on the intermediate transfer belt 22.

The print medium 60 is fed into a nip defined between the secondary transfer roller 24 and the backup roller 23. The print medium 60 is sandwiched together with the intermediate transfer belt 22 between the secondary transfer roller 24 and the backup roller 23, so that the full color toner image is transferred onto the print medium 60. The secondary transfer roller 24 receives a voltage having a polarity opposite to that of the charged toner from the high voltage controller/high voltage generator 54. In this manner, the print medium 60 having the toner image thereon is advanced to the fixing unit 81 (FIG. 1). The heat roller 32 of the fixing unit 81 applies heat to the toner image and the backup roller 33 applies pressure to the print medium 60 so that the toner image is fused into the print medium 60.

Then, the discharge roller 34 cooperates with the backup roller 35 to advance the print medium 60 out of the printer 11 to the stacker 36.

During continuous printing, the printer controller 52 controls the hopping roller 27 to begin to feed a following page of print medium 60 immediately after the trailing end of a preceding page passes the hopping roller 27. The printer controller 52 also begins to perform transfer of the respective color toner image of the following color onto the intermediate transfer belt 22 a predetermined time after the toner image of the preceding color is transferred onto the intermediate transfer belt 22. The registry roller 28 waits a predetermined time corresponding to an interval between adjacent toner images transferred onto the intermediate transfer belt 22, and then feeds the print medium 60 between the secondary transfer roller 24 and the backup roller 23. As described later, the color toner images are formed on the intermediate transfer belt 22 at 60 mm intervals and therefore the pages of print medium 60 are fed in sequence at 60 mm intervals, so that the full color toner image is transferred onto a corresponding page of print medium 60. In the first embodiment, the printer controller 52 generates commands for starting a transfer operation at predetermined intervals. The first embodiment may be modified in such a way that the printer controller 52 sends information representative of a toner image interval to the print engines 12Y, 12M, 12C, and 12BK. Then, the print engines 12Y, 12M, 12C, and 12BK store the information representative of the toner image interval, and then starts the image-forming process according to the interval.

The more closely adjacent toner images are formed on the intermediate transfer belt 22, the larger the throughput of the printer 11. The interval is selected taking into account the characteristics such as the accuracy of the sensor, not shown, that detects the trailing end of the print medium 60 and a time length required for preparing for the exposure of the next electrostatic latent image. In the first invention, adjacent toner images formed on the intermediate transfer belt 22 are spaced apart by 50 to 100 mm, preferably 60 mm. The printer controller 52 transmits the image data for the respective colors to the LED heads 13Y, 13M, 13C, and 13BK in accordance with a setting of interval between the toner images on the intermediate transfer belt 22.

A timer, not shown, in the printer controller 52 times a time elapsed after the image data is sent to the LED head 13Y for the print engine 12Y, thereby setting the interval between adjacent toner images to be formed on the intermediate transfer belt 22. The intervals between adjacent images may be determined by counting the drive pulses of the belt motor.

The print data does not always include data for yellow image. For example, if the print data includes only magenta and cyan images, the printer controller 52 generates an imaginary timing at which a yellow image is not actually transmitted, and transmits the imaginary timing to the LED head 14Y. Then, the printer controller 52 transmits the magenta image to the LED head 12M with respect to the imaginary timing, and then cyan image to the LED head 14C.

{Changing Toner Image Interval}

Referring to FIG. 1, an electrostatic latent image for yellow is formed at an exposure point P3 and is developed into a yellow toner image at a development point P1. Then, the yellow toner image on the intermediate transfer belt 22 arrives at the primary transfer roller 14Y where the yellow toner image is transferred onto the intermediate transfer belt 22. Then, the yellow toner image arrives at a second transfer point P2 where the yellow toner image is transferred from the intermediate transfer belt 22 to the print medium 60. The distance between the exposure point P3 and the second transfer point P2 is longer than the distance between the hopping roller 27 and the second transfer point P2.

The first embodiment is characterized in that when the paper cassette 26 approaches empty the printer controller 52 detects the presence and absence of the print medium 60 from the output of the medium sensor 31 before transmitting image data to the LED heads 13Y, 13M, 13C, and 13BK. The printer controller 52 detects when the number of pages remaining in the paper cassette 26 is, for example, 10 pages or less. Thereafter, the printer controller 52 increases the interval between adjacent toner images.

Figure 5:
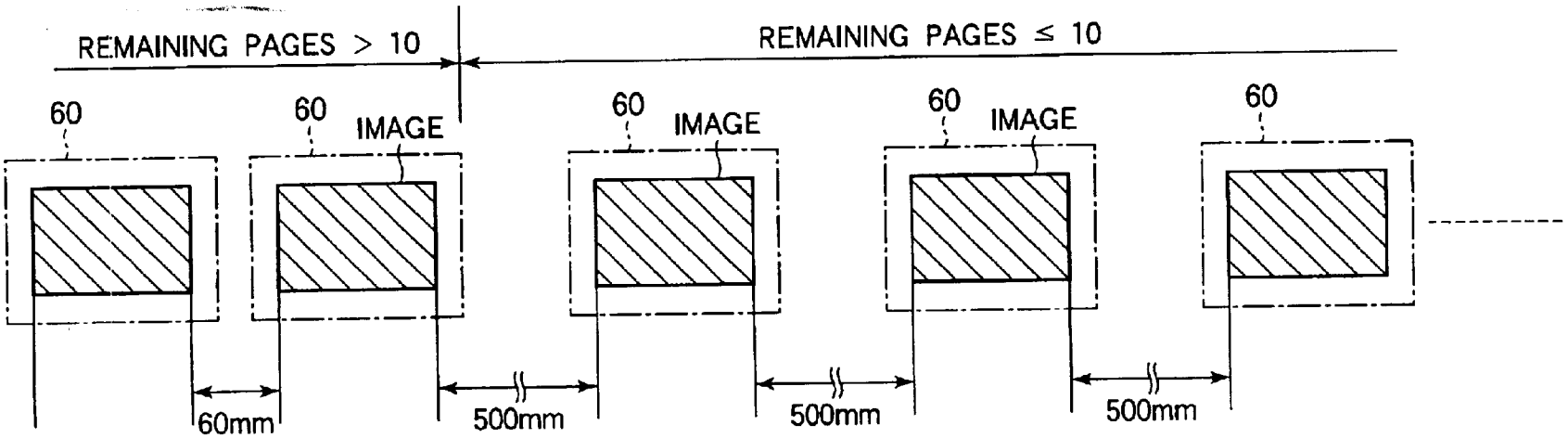
FIG. 5 illustrates the positional relationship between toner images and pages of print medium.

FIG. 5 illustrates the positional relationship between toner images and pages of print medium 60.

Referring to FIG. 5, if the paper cassette 26 holds more than 10 pages of print medium 60, image data of the respective colors is transmitted to the LED heads 13Y, 13M, 13C, and 13BK at such timings that the interval between adjacent toner images formed on the intermediate transfer belt 22 is 60 mm. If the paper cassette 26 holds less than 10 pages of print medium, the image data is transmitted to the print engines 12Y, 12M, 12C, and 12BK at such timings that the toner images of the respective colors are formed at 500-mm intervals.

In the first embodiment, the distance from the print engine 12Y to the secondary transfer roller 24 is 500 mm and therefore the toner image travels over the distance of 500 mm before it reaches the second transfer point P2. In other words, the image data for the following toner image is not transmitted to the LED heads 13Y, 13M, 130, and 13BK before the preceding toner image has been transferred onto the print medium 60 at the second transfer point P2. It follows that a following toner image is not formed before a preceding toner image reaches the second transfer point P2. Thus, when the paper cassette 26 runs out of print medium, for example, in the middle of a multi-page printing operation, the printer controller 52 generates a paper error signal before the next timing at which the image data of the respective colors is transmitted to the respective LED heads 13Y, 13M, 130, and 13BK. This operation prevents toner images from being formed on the intermediate transfer belt 22.

{Operation}

The operation in which toner images are formed at the aforementioned intervals will be described.

Figure 6:
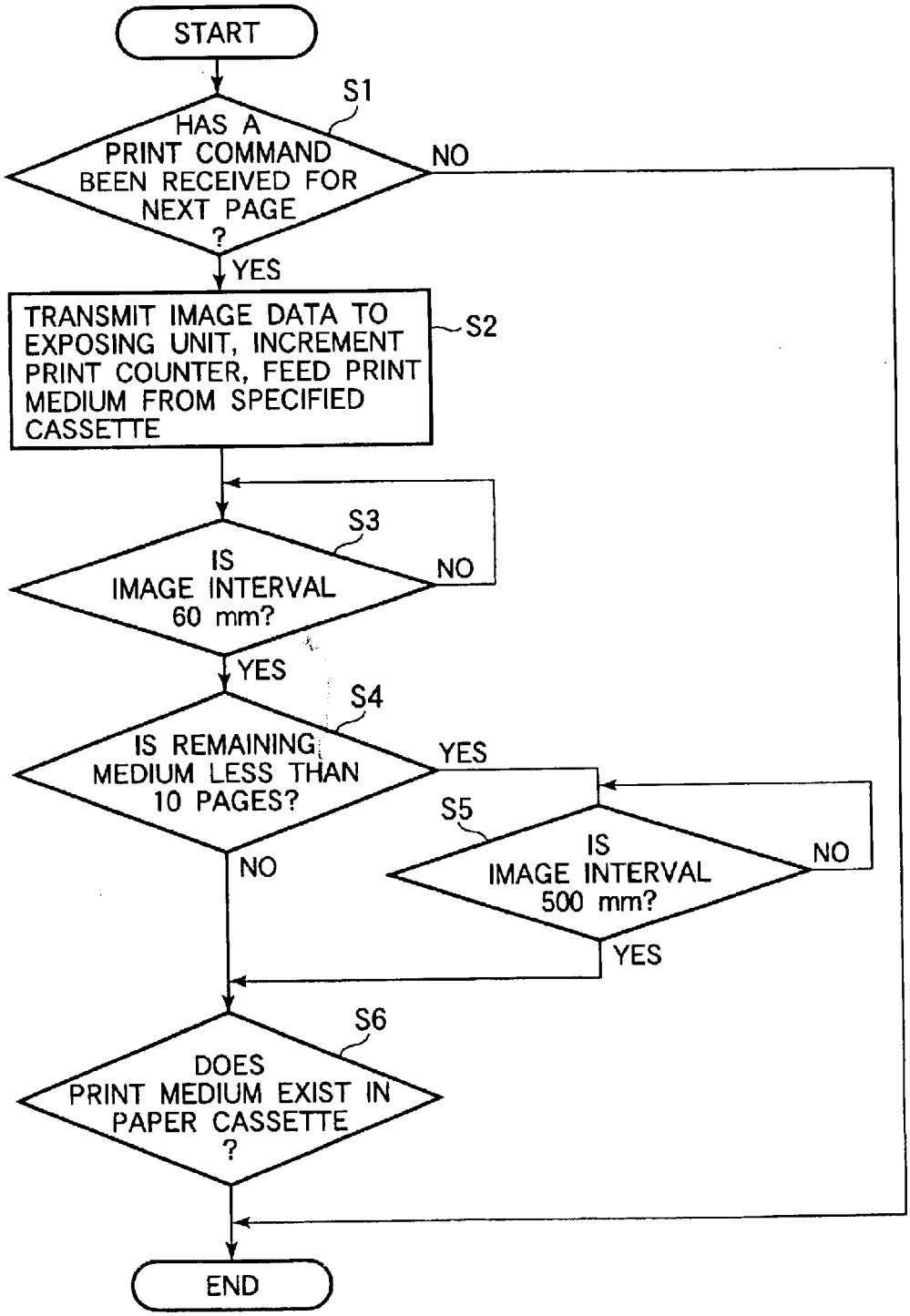
FIG. 6 is a flowchart illustrating the operation of the printer controller according to the first embodiment.

FIG. 6 is a flowchart illustrating the operation of the printer controller 52 according to the first embodiment.

Upon power up of the printer 11, the medium sensor 30 starts to monitor the presence and absence of the remaining print medium 60 in the paper cassette 26 and continues to monitor at all times. At step S1, the printer controller 52 (FIG. 2) determines whether a print command is received, and checks the output of the medium sensor 30 to determine whether the paper cassette 26 holds print medium 60. If YES, then the program proceeds to step S2 where printing is initiated. At step S2, the image data is transmitted to the respective LED heads 13Y, 13M, 130, and 13BK, the printer controller 52 controls the registry roller 28 (FIG. 1) at a predetermined timing to feed the print medium 60, and toner images are transferred onto the intermediate transfer belt 22. Then, the printer controller 52 increments a print counter by one. The print counter is a counter that counts the number of toner images (i.e., the number of pages printed). Then,the program proceeds to step 53 where the program waits until the image interval is set to 60 mm. If YES at step S3, then the program proceeds to step 54 where a check is made to determine whether the paper cassette 26 holds less than 10 pages of the print medium 60. If NO at step S4, the program ends and printing is continued normally. If YES at step S4, then the program proceeds to step S5 where a check is made to determine whether the image interval is set to 500 mm. If NO at step S5, the program waits until the image interval is set to 500 mm. Then, the program proceeds to step S6 where a check is made to determine whether the paper cassette 26 holds at least one page of print medium 60.

When the paper cassette 26 holds less than 10 pages of the print medium 60, the printer controller 52 waits until the interval between adjacent toner images is set to 500 mm. When the interval becomes 500 mm, the printer controller 52 begins to transmit the image data to initiate printing at an interval of 500 mm and the print counter is counted up. After the interval is set to 500 mm, the medium sensor 30 continues to monitor the remaining print medium 60 in the paper cassette 26 to determine whether the next toner image should be formed.

As described above, in the first embodiment, the interval between adjacent toner images is set through an interrupt task. The printer controller 52 determines from the output of the medium sensor 31 whether the paper cassette 26 holds pages of the print medium 60 less than a predetermined threshold value, for example, 10 . Then, the printer controller 52 sets the interval between adjacent toner images in accordance with the remaining print medium 60 in the paper cassette 26. If the paper cassette 26 holds more than 10 pages of the print medium 60 then the interval is set to 60 mm. If the paper cassette 26 holds less than 10 pages of the print medium 60, then the interval is set to 500 mm. The interval can be set by writing a value corresponding to the interval into, for example, a register, not shown in the printer controller 52.

Toner images of the respective colors can be formed prior to the feeding of the print medium 60 from the paper cassette 26, thereby increasing the printing speed i.e., the throughout of printing. When the paper cassette 26 approaches an empty state, the interval between adjacent toner images is set longer so that even when the paper cassette 26 runs out of print medium in the middle of a multi-page printing operation, the toner images are not left on the intermediate transfer belt 22. Increasing the toner image interval from 60 mm to 500 mm allows forming of toner images only after making sure that the print medium 60 exists in the paper cassette 26. This ensures that as soon as the paper cassette 26 runs out of the print medium 60, the transmission of image data to the LED heads 13Y, 13M, 13C, and 13BK is stopped. Thus, the first embodiment eliminates a case where toner images are formed on the intermediate transfer belt 22 but wasted.

Second Embodiment

{Construction}

Figure 7:
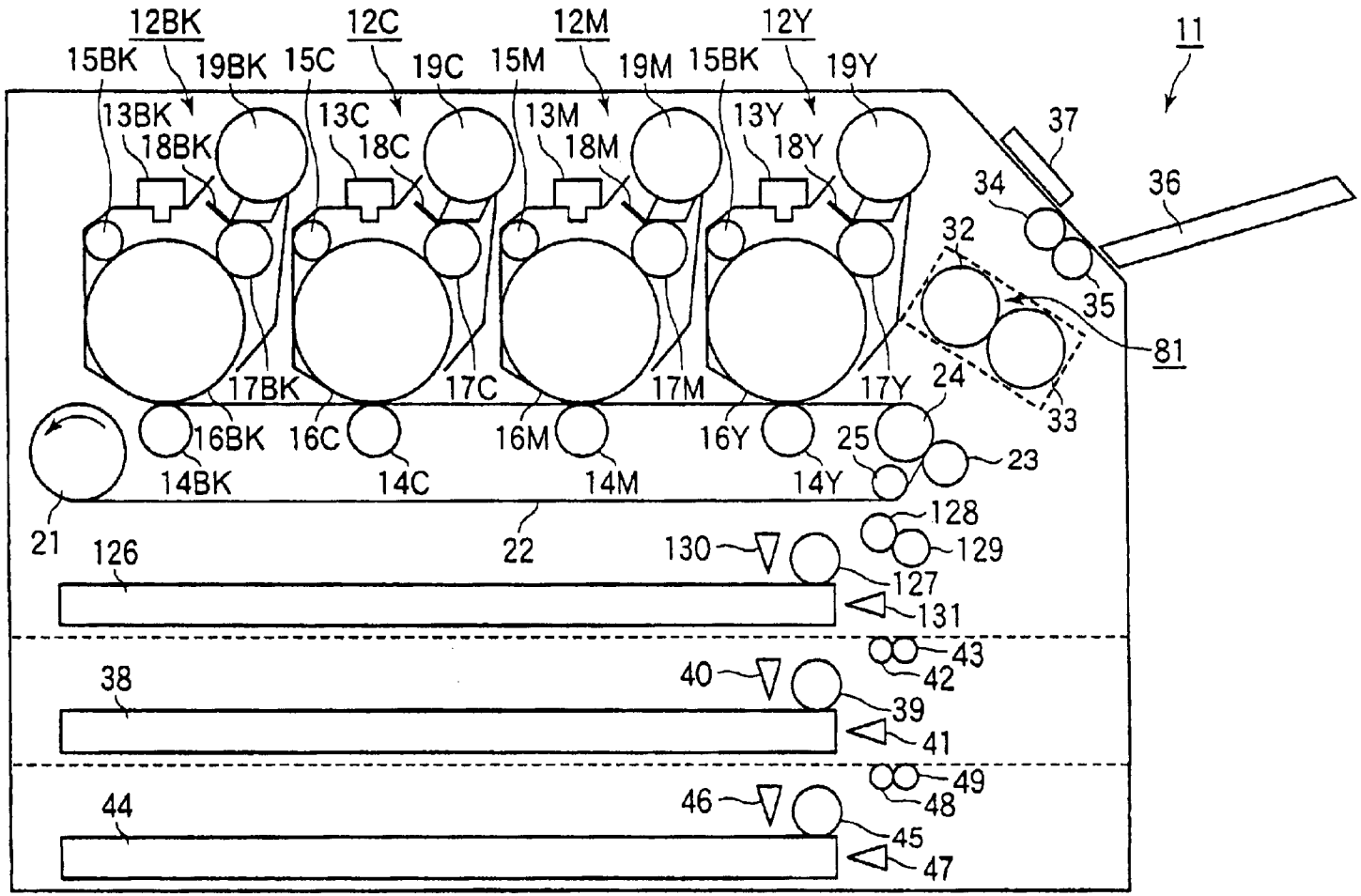
FIG. 7 illustrates the general configuration of a printer according to a second embodiment.

FIG. 7 illustrates the general configuration of a printer 11 according to a second embodiment.

Figure 8:
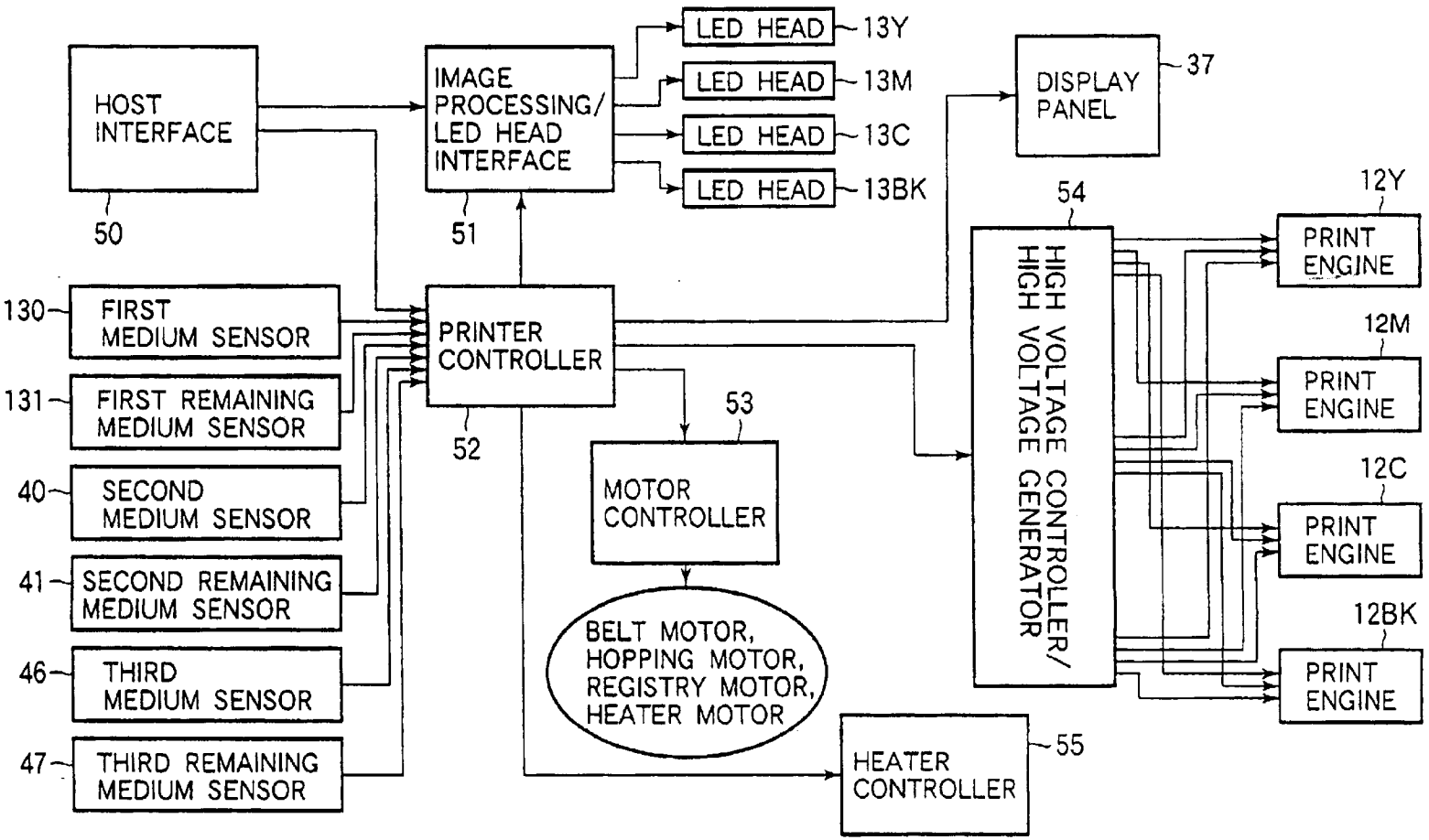
FIG. 8 is a control block of the printer of FIG. 2.

FIG. 8 is a control block of the printer 11 of FIG. 7.

Referring to FIGS. 7 and 8, first, second and third paper cassettes 126, 38, and 44 are disposed vertically. First, second, and third hopping rollers 127, 39, and 45 supply a page of print medium 60 at a time from the paper cassettes 126, 38, and 44, respectively. First, second, and third medium sensors 130, 40, and 46 detect the presence and absence of the print medium 60 in the paper cassettes 126, 38, and 44. First, second, and third remaining medium sensors 131, 41, and 47 detect the number of pages of remaining print medium 60 in the paper cassettes 126, 38, and 44, respectively. First, second, and third registry rollers 128, 42, and 48 cooperate with first, second, and third backup rollers 129, 43, and 49.

As shown in FIG. 7, the first, second, and third medium sensors 130, 40, and 46 and the first, second, and third sensors 131, 41, and 47 are connected to the printer controller 52.

{Mechanism for Detecting the Size of Print Medium}

Figure 9:
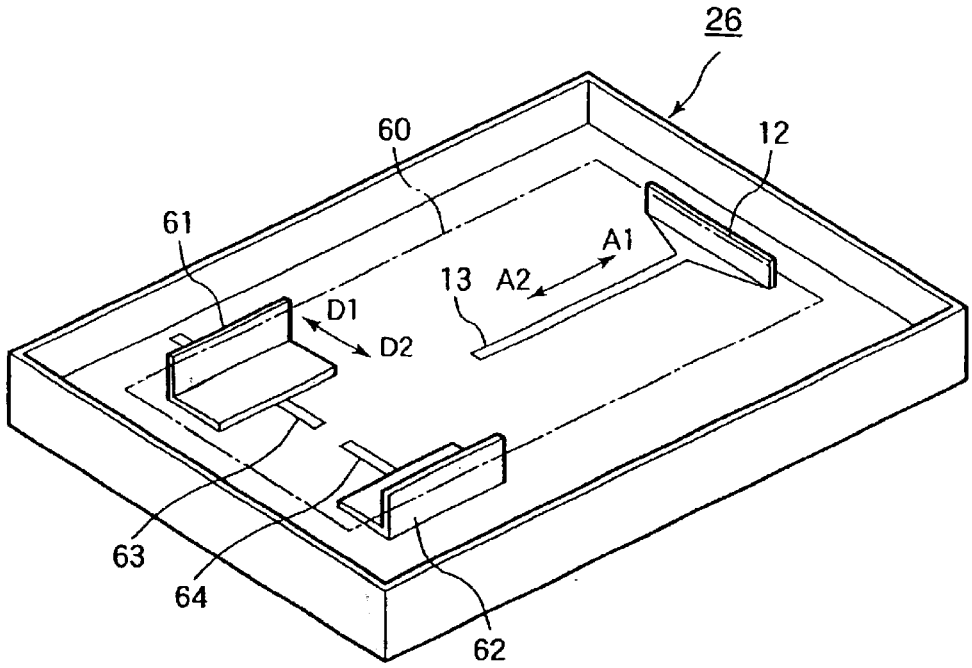
FIG. 9 is a perspective view, illustrating an example of a paper cassette according to the invention.

FIG. 9 is a perspective view, illustrating an example of a paper cassette 26 according to the invention.

The paper cassette 26 according to the invention has a mechanism for detecting the size of print medium 60 held therein. Referring to FIG. 9, a tail guide 12 is slidable in directions shown by arrows A1 and A2. Guides 61 and 62 are slidable in directions shown by arrows D1 and D2. A stack of the print medium 60 is held in the paper cassette 26 in such a way that the guides 61 and 62 abut the lateral edges of the print medium 60 and the tail guide 12 abuts the trailing end of the print medium 60. The print medium 60 is fed out of the paper cassette 26 in the direction shown by arrow A2.

Figure 10:
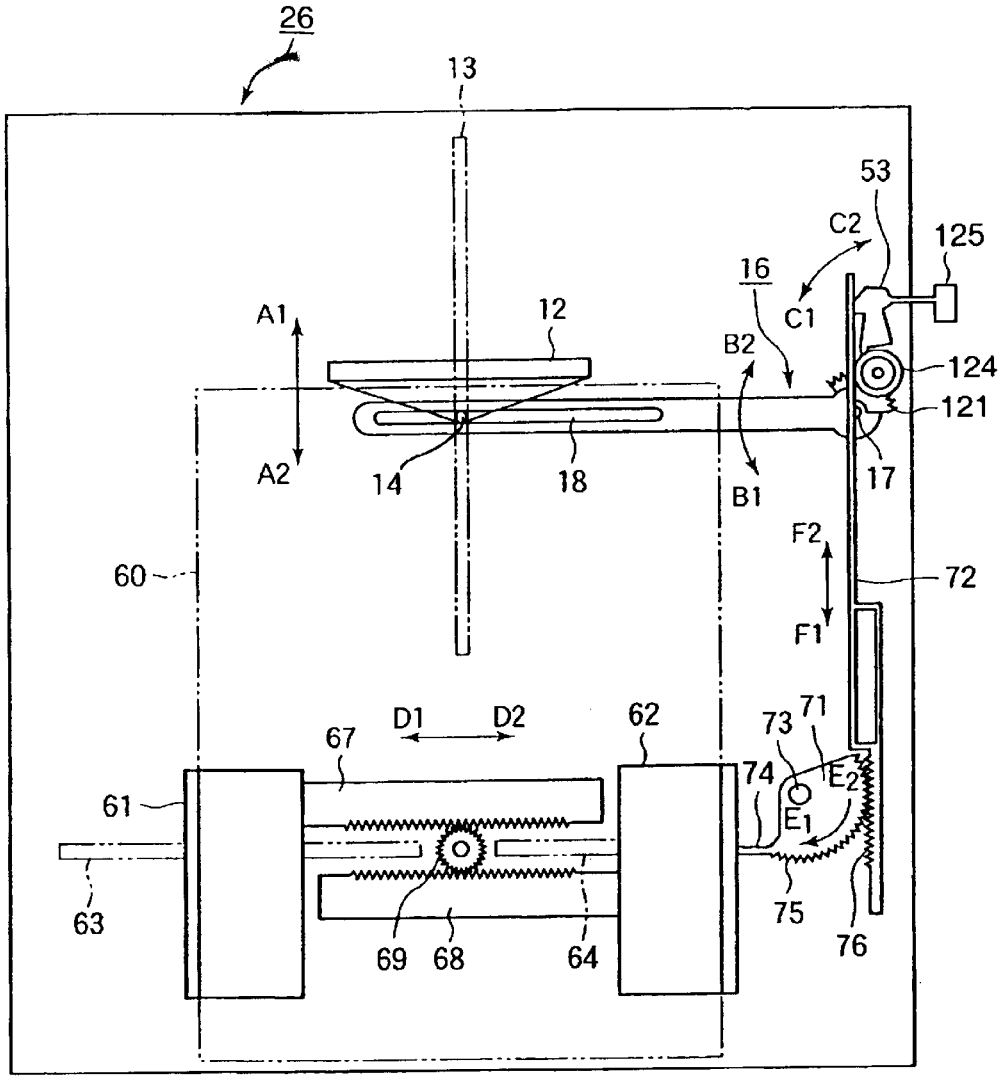
FIG. 10 is a top view of the paper cassette in FIG. 9.

FIG. 40 is a top view of the paper cassette 26 in FIG. 9. Referring to FIG. 10, the guides 61 and 62 have rack members 67 and 68 that engage a gear 69 in such a way that the guides 61 and 62 are movable toward and away from each other. The guides 61 and 62 have projections, not shown, which extend through grooves 63 and 64 and are guided along the grooves 63 and 64, respectively. A tail guide 12 has a pin 14 that extends through a groove 13 and is guided slidingly along the groove 13 in the directions shown by arrows A1 and A2. A pivot member 71 has a sector gear 75 and a projection 74 and is pivotal in the directions shown by arrows E1 and E2 about a pin 73. A slider 72 extends in a longitudinal direction thereof and has a rack 76 that is in mesh with the sector gear 75. When the pivot member 71 pivots in the directions shown by arrows E1 and E2, the slider 72 slides in the directions shown by arrows F1 and F2. The movement of the slider 72 in the directions of arrows F1 and F2 is transmitted to a switch actuator 53. A link 16 has one end connected to a sector gear 121 and the other end having an elongated hole 18 formed therein. The elongated hole 18 is engaged with the pin 14 formed on the tail guide 12, so that the sliding motion of the tail guide 12 in the directions shown by arrows A1 and A2 causes the link 16 to pivot about a pin 17 in the directions shown by the arrows B1 and B2. The pivotal movement of the link 16 is transmitted through the sector gear 121 in the directions shown by the arrows C1 and C2 to a drum 124. The rotational position of the drum 124 is transmitted to the switch actuator 53, which in turn causes switches in a switch unit 125 to become on and off.

Combinations of the on states and off states of the switches represent the corresponding sizes of the print medium 60.

As described above, the combination of the linear displacement of the slider 72 and the angular displacement of the link 16 causes the switch unit 125 to generate a detection signal indicative of the size of print medium 60.

{Overall Operation}

The overall operation of the printer 11 of the aforementioned configuration will be described.

Just as in the first embodiment, when a paper cassette 26 holds more than 10 pages of print medium 60, the printer controller 52 sets the interval to a minimum value (e.g., 60 mm). When the number of pages of remaining print medium 60 in the paper cassette 26 decreases below 10 pages in the middle of a multi-page printing job, the printer controller 52 sets the interval to a next larger value, if an adjacent paper cassette 26 holds the print medium 60 of the same size. Thus, if the paper cassette 26 holds 10 pages or less when a printing operation is activated, the transmission of the image data to the LED head 13Y is delayed so that toner images are formed at the larger interval, for example, 160 mm.

The length of the intermediate transfer belt 22 is selected to meet the following conditions. That is, for example, an A4 size print medium 60 is fed to the print engines 12Y, 12M, 12C, and 12BK in such an orientation that the long sides of the print medium 60 are substantially perpendicular to the direction of travel of the print medium 60. Then, two toner images can be formed at the interval of 60 mm on the intermediate transfer belt 22, and one and ¾ toner images can be formed at the interval of 160 mm on the intermediate transfer belt 22.

Figure 11:
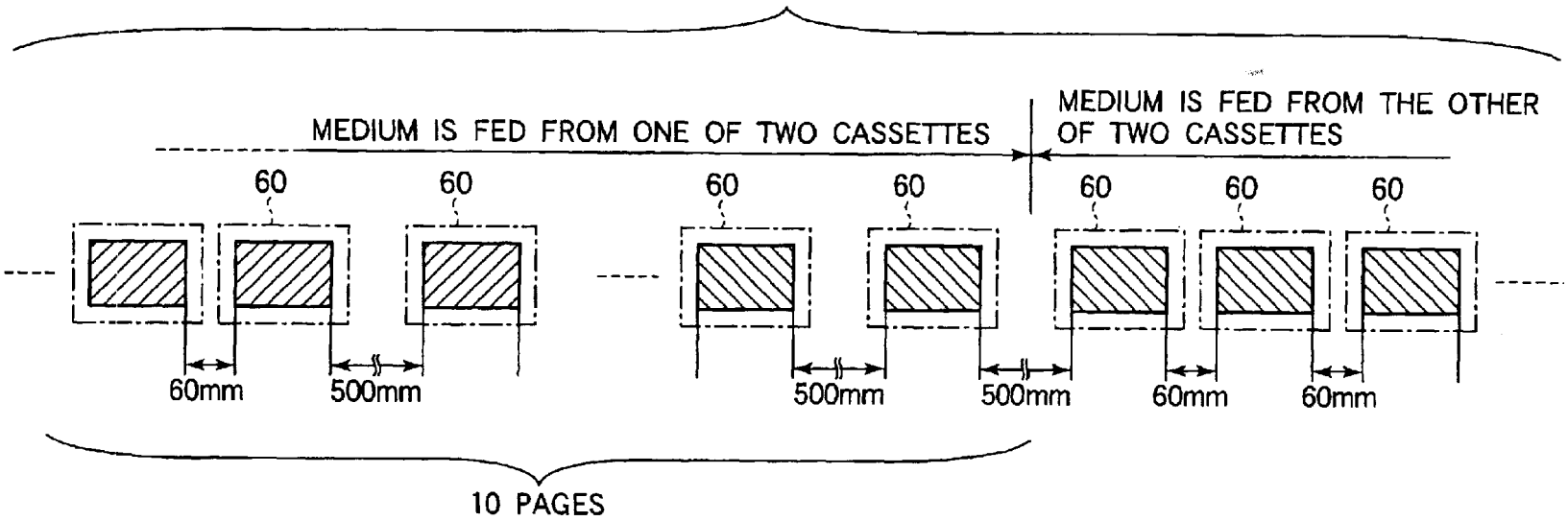
FIG. 11 illustrates the positional relationship between toner images and the print medium.

FIG. 11 illustrates the positional relationship between toner images and the print medium 60 when the number of pages of print medium in a paper cassette decreases below 10 pages and when switching is made from one paper cassette to another.

For example, at least two of the paper cassettes 126, 38, and 44 hold a print medium 60 of the same size. When one of the two paper cassettes runs out of print medium 60 in the middle of a multi-page printing job, the printer controller 52 switches from the paper cassette that runs out of the print medium 60 to another paper cassette that holds sufficient pages of print medium 60. There is a difference in the length of medium transport path between the two paper cassettes. When the first page is fed from the paper cassette that holds sufficient pages of print medium 60 shortly after the paper cassettes are switched, there is a delay time in feeding the first page due mainly to the difference in the length of medium transport path. Therefore, when the number of pages of remaining print medium 60 becomes less than 10 pages, the printer controller 52 increases the toner image interval to, for example, 500 mm as shown in FIG. 11. The interval is selected in accordance with the difference in the length of transport path because the length of transport path varies depending on the locations of paper cassettes within the printer 11. After a toner image is transferred onto the first page fed from the paper cassette that holds sufficient pages of print medium 60, the toner image interval is set back to the original value. Therefore, toner images are formed at the original toner intervals (60 mm) for pages after the first page.

A sufficiently long interval causes no delay in transferring toner images onto the print medium 60 even when the switching of paper cassettes takes place in the middle of a multi-page printing operation, but the resulting throughput in printing is too low.

Figure 12:
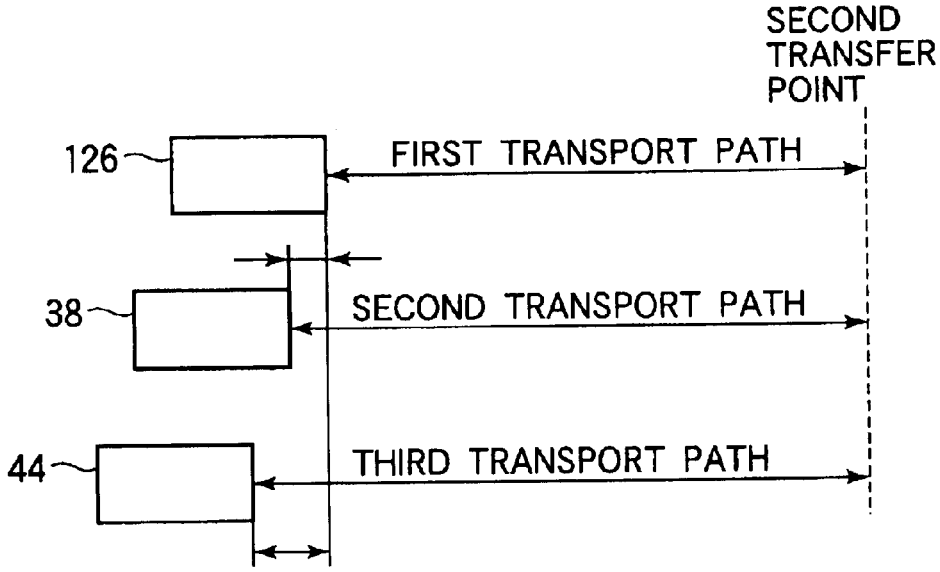
FIG. 12 illustrates the difference in medium transport path between adjacent paper cassettes.

FIG. 12 illustrates the difference in medium transport path between adjacent paper cassettes 126, 38, and 44.

In the second embodiment, the difference in medium transport path between adjacent paper cassettes 126 and 38 is 100 mm. The difference in medium transport path between adjacent paper cassettes 38 and 44 is 100 mm. As described above, the image interval is increased to 100 mm when the number of pages of print medium 60 held in the paper cassette 126 decreases below 10 and switching is going to take place from the first paper cassette 126 to the second paper cassette 38. Likewise, the image interval is increased to 260 mm when the number of pages of print medium 60 in the first paper cassette 126 decreases below 10 and switching is going to take place from the first paper cassette 126 to the third paper cassette 44.

The interval is then set back to 60 mm shortly after the first page has been fed from a paper cassette that holds the print medium 60 of the same size. In other words, it is only necessary to increase the image interval when the paper cassette holds less than 10 pages of print medium 60 and when the first page is fed shortly after switching is made from one paper cassette to another in the middle of a multi-page printing job. Maintaining an increased image interval for such a limited period does not sacrifice the throughput of printing.

{Overall Operation}

A description will be given of the operation of the printer 11 when the number of pages of print medium 60 in a paper cassette decreases below a threshold value. In the second embodiment, a switching is made from a paper cassette that runs out of print medium 60 to a paper cassette closer to the paper cassette that runs out of the print medium 60.

Figure 13A:
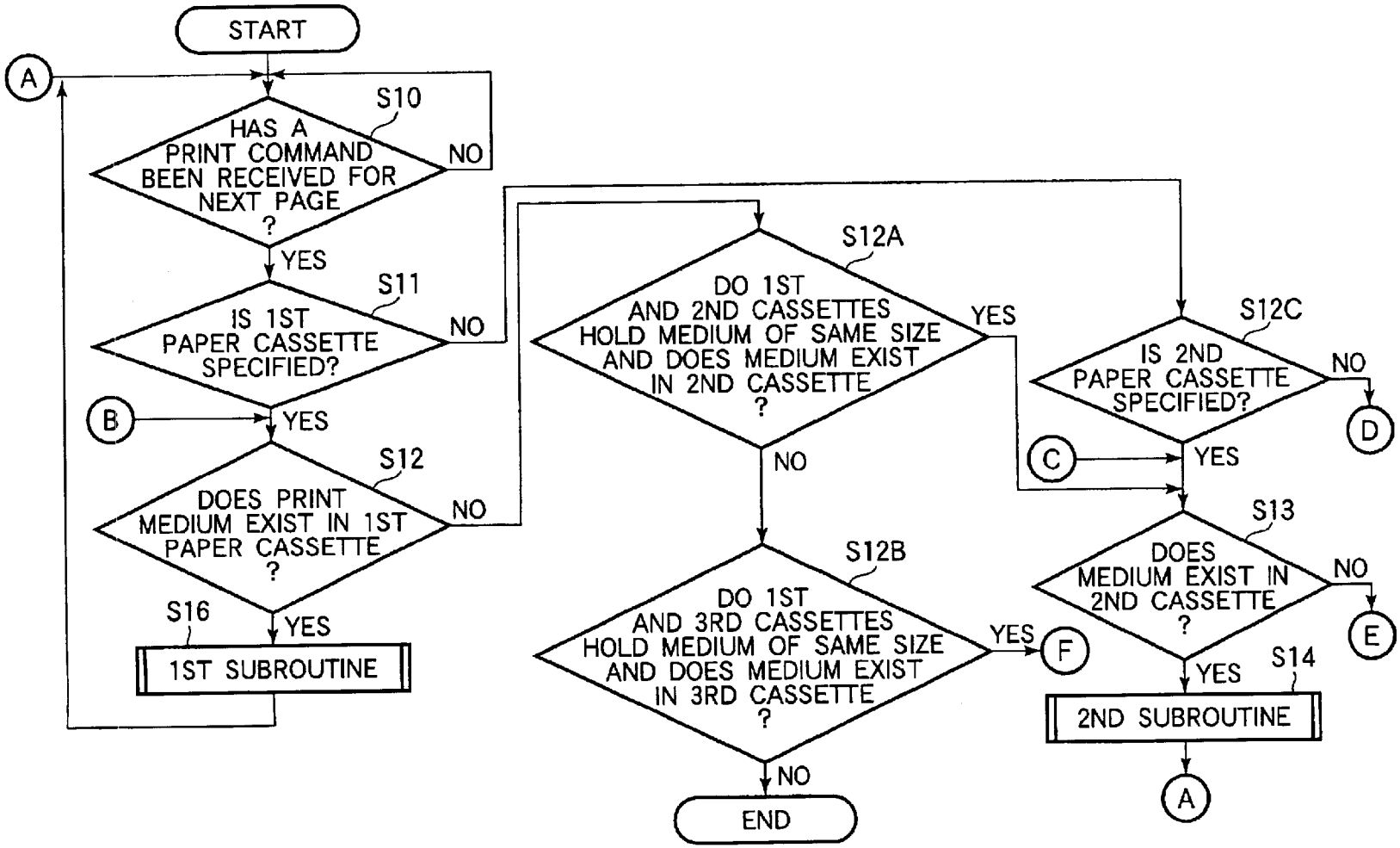
FIGS. 13A and 13B and FIG. 14 are flowcharts, illustrating the operation of the printer controller.
Figure 13B:
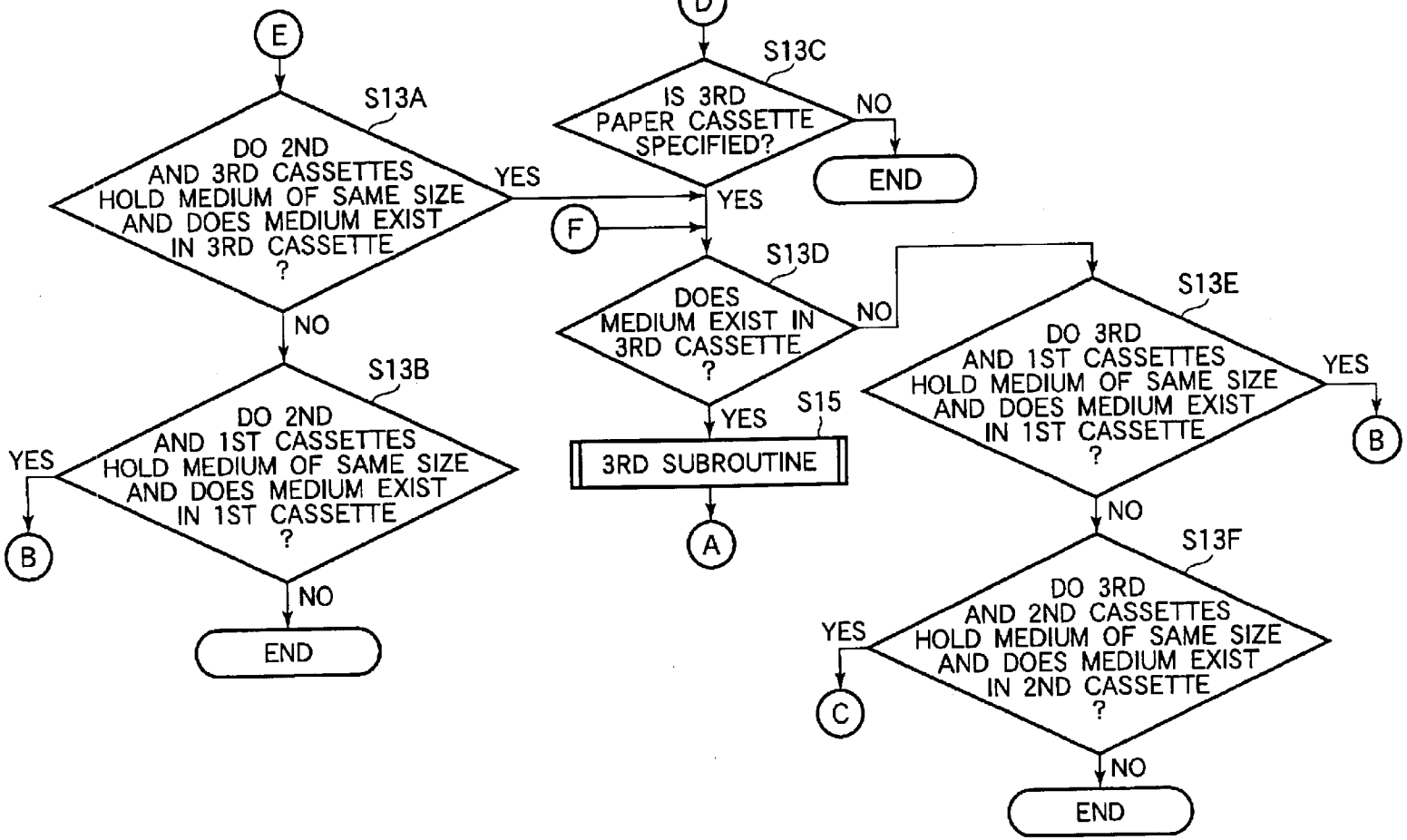

FIGS. 13A and 13B show a flowchart, illustrating the operation of the printer controller 52.

Referring to FIGS. 13A and 13B, upon power-up, the first, second, and third remaining medium sensors 131, 41, and 47 start monitoring the pages of remaining print medium 60 in the paper cassettes 126, 38, and 44, and continue to monitor the pages of remaining print medium 60 at all times.

Within the same print job, the printer controller 52 executes the program in FIGS. 13A and 13B as many times as there are pages in the print job. At step S10, a check is made to determine whether a print command for the next page has been received. If YES at step S10, the program proceeds to step S11 where a check is made to determine whether a first paper cassette 126 is specified. If NO at step S11 the program proceeds to step S12C; if YES, then the program proceeds to step S12 where a check is made to determine whether print medium 60 exists in the first paper cassette 126. If NO at step S12, the program proceeds to S12A.

If the print medium 60 does not exist in the first paper cassette 126 (NO at step S12), then the program proceeds to step S12A. At step S12A, a check is made to determine whether the first and second paper cassettes 126 and 38 are used for holding a print medium 60 of the same size and the print medium 60 exists in the second paper cassette 38. If YES at step S12A, the program proceeds to step S13 where a check is made to determine whether a print medium 60 exists in the second paper cassette 38. If NO at step S12A, the program proceeds to step S12B where a check is made to determine whether the first and third paper cassettes 126 and 44 are used for holding a print medium 60 of the same size and the print medium 60 exists in the third paper cassette 44. If NO at step S12B, the program ends; if YES, then the program jumps to S13D.

If YES at step S12C, the program proceeds to step S13; if NO, then program proceeds to step S13C where a check is made to determine whether the third paper cassette 44 is specified. If YES, at step S13, then the program proceeds to S14 where the second cassette-switching operation is performed. If NO at step S13, then the program proceeds to a step S13A where the second and third paper cassettes 38 and 44 are used to hold a print medium 60 of the same size and the print medium 60 exists in the third paper cassette 44. If YES at step S13A, the program proceeds to step S13D. If NO at step S13A, then the program proceeds to step S13B where a check is made to determine whether the second and first paper cassettes 38 and 126 are used to hold a print medium 60 of the same size and the medium exists in the first paper cassette 126. If NO at step S13B, the program ends; if YES, the program jumps to step S12.

If NO at step S13C, the program ends; if YES, the program proceeds to step S13D where a check is made to determine whether the print medium 60 exists in the third paper cassette 44. If YES at step S13D, the program proceeds to step S15 where a third subroutine is executed. If NO at step S13D, the program proceeds to step S13E where a check is made to determine whether the third and first paper cassettes 44 and 126 are used to hold a print medium 60 of the same size and the print medium 60 exists in the first cassette 126. If YES at step S13E, the program jumps to step S12. If NO at step S13E, the program proceeds to step S13F where a check is made to determine whether third and second paper cassettes 44 and 38 are used to hold a print medium 60 of the same size and the medium exists in the second paper cassette 38.

{First Subroutine}

Figure 14:
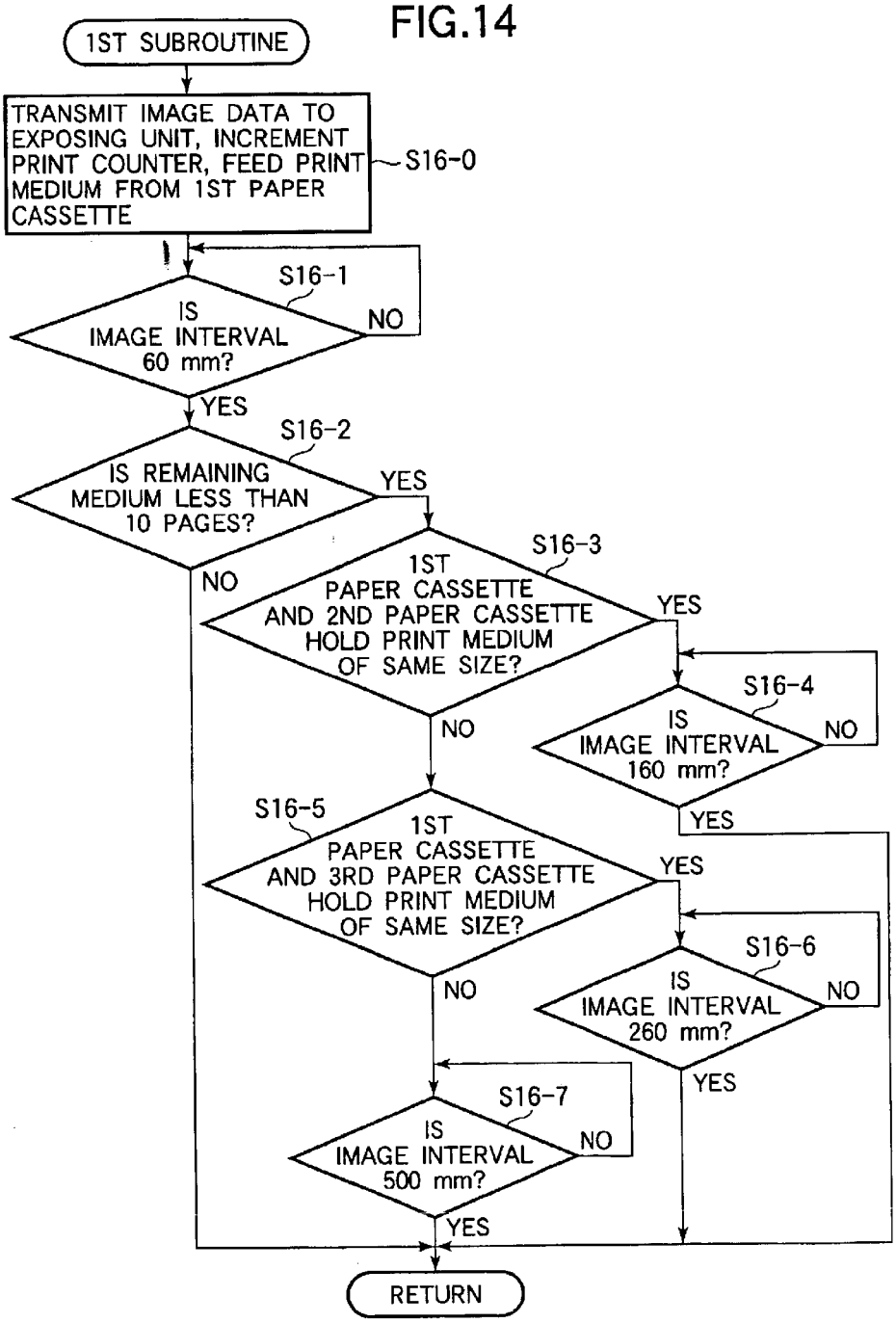

FIG. 14 is a flowchart, illustrating the operation of the first cassette-switching operation.

If the print medium 60 exists in the first paper cassette 126 (YES at step S12), the program proceeds to step S16 where the first cassette-switching operation is performed (S16-0 to S16-7). That is, the program proceeds to step S16-0 where the printing of a page is initiated and the print counter is counted up. The image data is transmitted to the LED heads 13Y, 13M, 13C and 13BK, the print counter is incremented, and a page of print medium 60 is fed from a specified paper cassette. Then, the program proceeds to step S16-1 where a check is made to determine whether the program waits until the image interval is set to 60 mm. If YES, at step S16-1, the program proceeds to step S16-2 where a check is made to determine whether the remaining print medium 60 is less than 10 pages. If NO at step S16-2, the printer controller 52 initiates a printing operation for one page in which image data is transmitted to the LED heads 13Y, 13M, 13C, and 13BK at predetermined timings. The printer controller 52 also controls the registry roller 128 to feed the print medium 60 at a predetermined timing. The image data is transmitted to the LED heads 13Y, 13M, 13C, 13BK and the print medium 60 is fed to the second transfer point P2 at timings corresponding to an image interval of 60 mm. Then, the printer controller 52 controls the print counter to count up, and then completes a cassette switching processing.

If YES at step S16-2, the program proceeds to step S16-3 where a check is made to determine whether the paper cassettes 126 and 38 hold the print medium 60 of the same size. If YES at step S16-3, then the program waits until the image interval is 160 mm (step S16-4). If YES at step S16-4, the subroutine program returns. The image data is transmitted to the LED heads 13Y, 13M, 13C, 13BK and the print medium 60 is fed to the second transfer point P2 at timings corresponding to an image interval of 160 mm.

If NO at step S16-3, the program proceeds to step S16-5 where a check is made to determine whether the first and third paper cassettes 126 and 44 hold the print medium 60 of the same size. If YES at step S16-5, the program proceeds to step S16-6 where program waits until the image interval is 260 mm. Then, the subroutine program returns. At timings corresponding to an image interval of 260 mm, the image data is transmitted to the LED heads 13Y, 13M, 13C, 13BK and the print medium 60 is fed to the print engine 12Y.

If the paper cassettes 126, 38, and 44 hold the print medium 60 of different sizes (NO at step S16-5), the program proceeds to step S16-7 where the print controller 52 does not switch the paper cassettes but waits until the image interval is 500 mm (S16-7). If YES at step S16-7, the subroutine program returns. In other words, at timings corresponding to the image interval of 500 mm, the image data is transmitted to the LED heads 13Y, 13M, 13C, 13BK and the print medium 60 is fed to the print engine 12Y.

{Second Subroutine}

Figure 15:
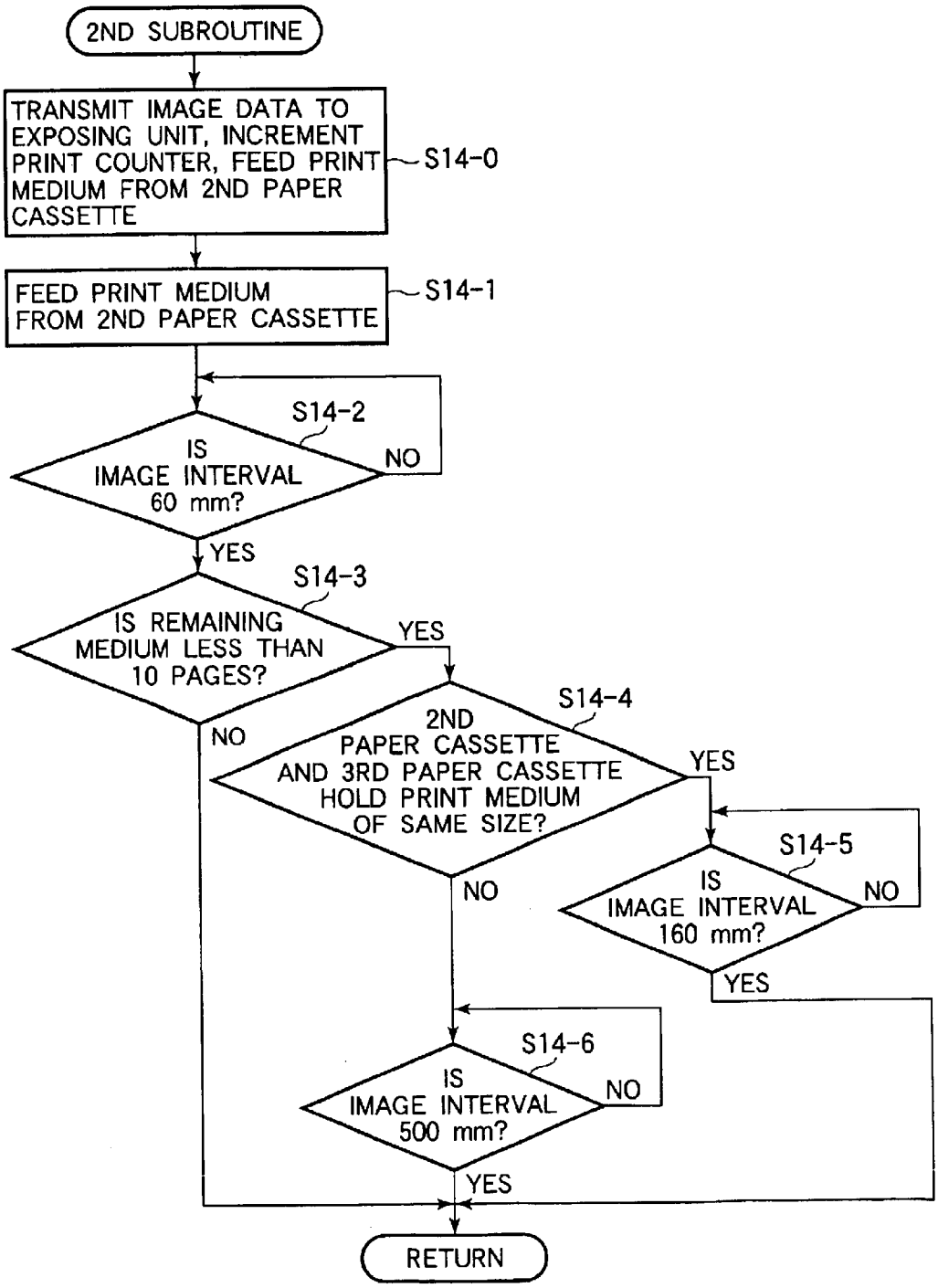
FIG. 15 is a flowchart, illustrating the operation of the second cassette switching operation.

FIG. 15 is a flowchart, illustrating the operation of the second cassette-switching operation.

The second cassette switching operation will now be described with reference to FIG. 15.

At step S14-0, the printing of a page is initiated and the print counter is counted up, i.e., the image data is transmitted to the LED heads 13Y, 13M, 13C, 13BK, the print counter is incremented, and a page of print medium 60 is fed from a specified paper cassette. At step S14-1, a page of print medium 60 is fed from the second paper cassette. At step S14-2, the program waits until the image interval is 60 mm. Then, at step S14-3, a check is made to determine whether the remaining print medium 60 is less than 10 pages. If NO at step S14-3, the print medium 60 is fed and a printing operation from one page begins. If YES at step S14-3, then the program proceeds to step S14-4 where a check is made to determine whether the second paper cassette and the third paper cassette hold the print medium 60 of the same size. If YES at step S14-4, then the program waits at step S14-5 until the image interval is 160 mm. Then, printing is continued until the second paper cassette becomes empty, and the printing is further continued by feeding the print medium 60 from the third cassette.

If NO at step S14-4, then the program waits at step S14-6 until the image interval becomes 500 mm. After the image interval becomes 500 mm, the print medium 60 continues to be fed from the second paper cassette.

{Third Subroutine}

Figure 16:
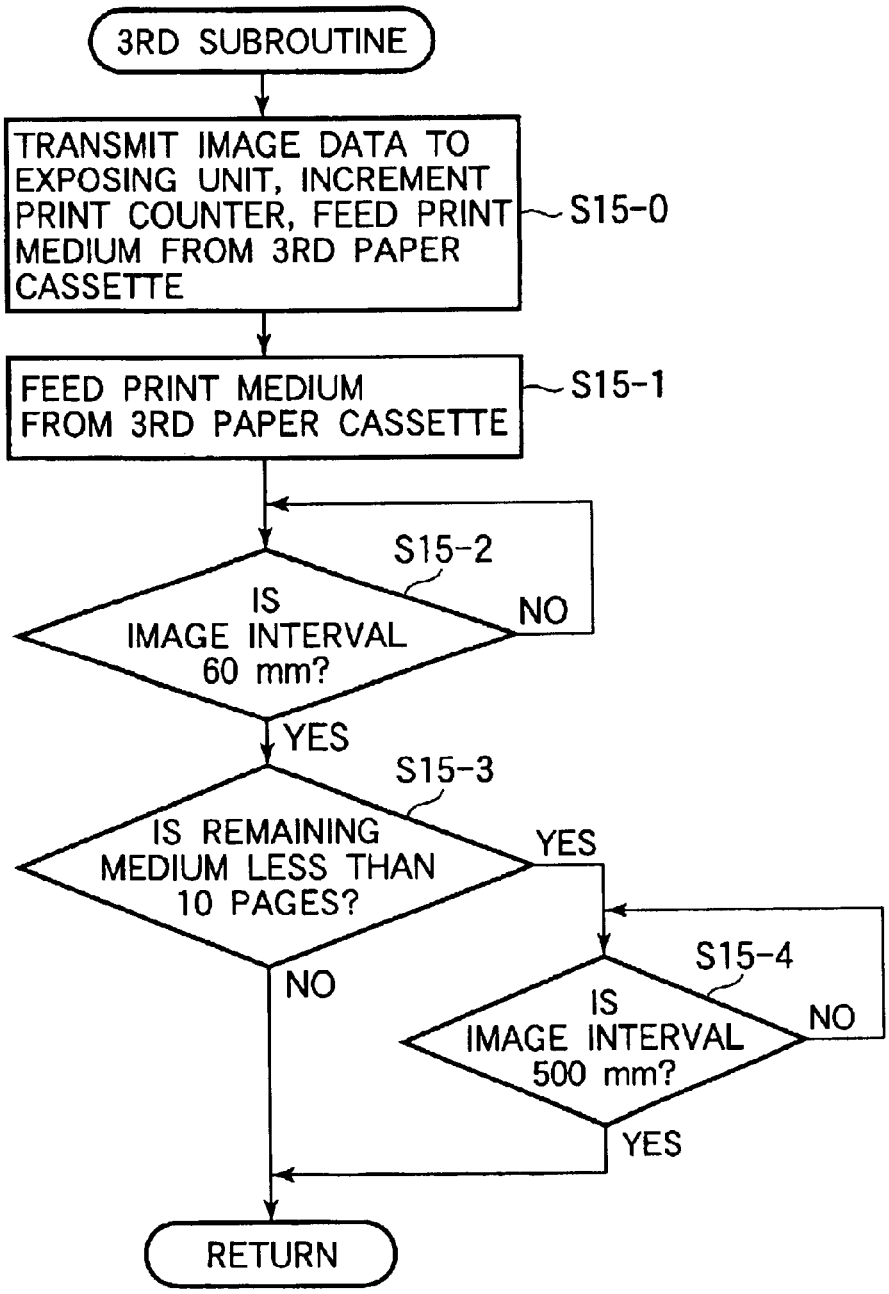
FIG. 16 is a flowchart, illustrating the operation of the third cassette switching operation.

FIG. 16 is a flowchart, illustrating the operation of the third cassette-switching operation.

The third cassette switching operation will now be described with reference to FIG. 16.

At step S15-0, the printing of a page is initiated and the print counter is counted up, i.e., the image data is transmitted to the LED heads 13Y, 13M, 13C, 13BK, the print counter is incremented, and a page of print medium 60 is fed from a specified paper cassette. At step S15-1, a page of print medium 60 is fed from the third paper cassette. At step S15-2, the program waits until the image interval becomes 60 mm. Then, the program proceeds to step S15-3 where a check is made to determine whether the third paper cassette 44 (FIG. 7) holds less than 10 pages of the print medium 60. If NO at step S15-3, then a printing operation begins. If YES at step S15-3, the program waits at step S15-4 until the image interval becomes 500 mm. If YES at step S15-4, then a printing operation begins.

{Modification}

In the second embodiment, a switching is performed only between paper cassettes that hold print medium of the same size and not between paper cassettes that hold print medium of different sizes. Alternatively, a switching may be made from a paper cassette that holds print medium of a small size to a paper cassette that holds print medium of a larger size. Still alternatively, a switching may be made to an arbitrary paper cassette that holds print medium of the same size, in which case, the image interval is changed in accordance with the difference in medium transport path between a paper cassette that runs out of the print medium to a paper cassette that holds a sufficient amount of the print medium. If a paper cassette is switched to a farther paper cassette, the image interval is increased by a large value. If a paper cassette is switched to a closer paper cassette, the image interval is increased by a small value.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image recording apparatus comprising:

an image forming section that forms images;

a medium cassette that holds a stack of print medium;

a remaining medium detector that detects remaining print medium held in said medium cassette;

a primary transfer section configured to transfer the images from said image forming section to a primary medium;

a secondary transfer section configured to transfer the images from the primary medium to the print medium fed from the medium cassette;

a controller that controls distance intervals at which said image forming section forms the images, the distance intervals being controlled in accordance with the remaining print medium, wherein when said remaining-medium detector detects that the remaining print medium is equal to or below a reference value, said controller causes said image forming section to form the images at distance intervals which are between a first length of medium transport path and a difference between the first length of medium transport path and a second length of medium transport path, the first length being from said image forming section to said secondary transfer section and the second length being from said medium cassette to said secondary transfer section.

2. The image recording apparatus of claim 1, wherein said controller causes said image forming section to form the images at first timings when said medium cassette holds remaining print medium of more than the reference value;

said controller causes said image forming section to form the images at second timings when said medium cassette holds remaining print medium equal to or less than the reference value; and the second timings are delayed relative to the first timings such that the images are formed at greater distance intervals on the primary medium when the images are formed at the second timings than when the images are formed at the first timings.

3. The image recording apparatus of claim 1, wherein when said medium cassette holds remaining print medium of equal to or below a reference value, said controller changes the distance intervals at which said image forming section forms the images, the images being formed after said controller determines that the medium cassette holds print medium.

4. The image recording apparatus of claim 1 including a plurality of medium cassettes, a first medium cassette being one of the plurality of medium cassettes, each of the plurality of medium cassettes having a corresponding remaining-medium detector, wherein when the first medium cassette holds remaining print medium more than the reference value during a printing job, said controller feeds the print medium from the first medium cassette to said secondary transfer section; and when the first medium cassette becomes empty of the print medium in the middle of the printing job, said controller feeds the print medium from another of the plurality of medium cassettes to said secondary transfer section instead of the first medium cassette, the another medium cassette holding a stack of print medium therein.

5. The image recording apparatus of claim 4, wherein the first medium cassette holds pages of first print medium having a first size and the another medium cassette holds pages of second print medium having a second size, the first size being smaller than the second size.

6. The image recording apparatus of claim 1, wherein said controller causes said image forming section to form the images at first distance intervals when the print medium is fed from the medium cassette that holds pages of the print medium of more than the reference value;

wherein said controller causes said image forming section to form the images at second distance intervals when the medium cassette holds pages of the print medium equal to or less than the reference value, the second distance intervals being longer than the first distance intervals.

7. The image recording apparatus of claim 1, wherein said image forming section is one of a plurality of image forming sections, the plurality of image forming sections forming images in registration with one another.

8. The image recording apparatus of claim 7, wherein said controller causes said image forming sections to form the images at distance intervals larger than a difference between a first distance and a second distance, the first distance being a distance from an image forming section most upstream in a direction in which said primary medium transports the images to the secondary transfer section and the second distance being a distance from the medium cassette to said secondary transfer section.

9. The image recording apparatus of claim 7, wherein said image forming sections are arranged to configure a tandem type image recording apparatus.

10. The image recording apparatus of claim 1, further comprising a display that indicates that the number of pages in said medium cassette is less than a reference value.

11. The image recording apparatus of claim 1, wherein the primary medium is a transfer belt.

12. The image recording apparatus of claim 1, wherein the primary medium is a transfer drum.

13. The image recording apparatus of claim 1, wherein said medium cassette includes a medium-holding member that holds the stack of the print medium thereon and takes up a different position in accordance with a number of pages of the print medium remaining in the medium cassette, wherein the remaining medium detector detects the number of pages of the print medium held in the medium cassette in terms of a position of the medium-holding member.

14. The image recording apparatus of claim 13, wherein the medium-holding member has a reflective member, so that the remaining medium detector detects the number of pages of the print medium held in the medium cassette in terms of a position of the medium-holding member.

15. The image recording apparatus of claim 1, wherein said secondary transfer section is located at one end of the medium transport path and said medium cassette is located at another end of the medium transport path at which the print medium is fed to the medium transport path.

16. The image recording apparatus of claim 15, wherein said remaining-medium detector is mounted on said medium cassette and is in proximity to the another end of the medium transport path.

17. An image recording apparatus comprising:

an image forming section that forms images;

a primary transfer section configured to transfer the images from said image forming section to a primary medium;

a plurality of medium cassettes, each of which holds a stack of print medium;

a remaining-medium detector mounted to each of said plurality of medium cassettes, each remaining-medium detector configured to detect remaining print medium held in a corresponding one of said plurality of medium cassettes;

a secondary transfer section configured to transfer the images from the primary medium to the print medium fed from one of said plurality of medium cassettes; and a controller that controls a timing at which said image forming section forms the images, the timing being controlled in accordance with the remaining print medium, wherein when a first medium cassette of the plurality of medium cassettes holds print medium more than the reference value, said controller feeds the print medium from the first medium cassette to said secondary transfer section and causes said image forming section to form the images at first distance intervals;

when the first medium cassette becomes empty of the print medium, said controller feeds a first page of the stack of print medium from a second medium cassette of said plurality of medium cassettes to said secondary transfer section and causes said image forming section to form an image such that an image for a final page from the first medium cassette and an image for the first page from the second medium cassette are spaced apart by a second distance interval, the second distance interval being longer than the first distance interval; and when the controller feeds the print medium from the second medium cassette after the first page of the stack of print medium is fed from the second medium cassette, said controller causes said image forming section to form the images at the first distance intervals.

18. An image recording apparatus comprising:

an image forming section that forms images;

a primary transfer section configured to transfer the images from said image forming section to a primary medium;

a plurality of medium cassettes, each of which holds a stack of print medium;

a remaining-medium detector mounted to each of said plurality of medium cassettes, each remaining-medium detector configured to detect remaining print medium held in a corresponding one of said plurality of medium cassettes;

a secondary transfer section configured to transfer the images from the primary medium to the print medium fed from one of said plurality of medium cassettes; and a controller configured to cause said image forming section to form the images at different distance intervals in accordance with the remaining print medium, wherein when a first medium cassette of the plurality of medium cassettes holds print medium more than a reference value, said controller feeds the print medium from the first medium cassette;

when the first medium cassette becomes empty of the print medium, said controller feeds the print medium from a second medium cassette of said plurality of medium cassettes; and when the print medium in the first medium cassette decreases below the reference value, said controller causes said image forming section to form images at different distance intervals in accordance with a difference in medium transport path between when the print medium is fed from the first medium cassette and when the print medium is fed from the second medium cassette.

19. The image recording apparatus of claim 18, wherein said controller causes said image forming section to form the images at first distance intervals when the print medium is fed from the first medium cassette that holds pages of the print medium of more than the reference value;

wherein said controller causes said image forming section to form an image in such a way that an image for a final page fed from the first medium cassette and the image for the first page fed from the second medium cassette are spaced apart by a second distance interval, the second distance interval being longer than the first distance interval;

wherein said controller causes said image forming section to form the images at the first distance interval when said controller feeds pages of the print medium from the second medium cassette after the first page of the stack of print medium is fed from the second medium cassette.

20. The image recording apparatus of claim 18, wherein the first medium cassette holds pages of first print medium having a first size and the second medium cassette holds pages of second print medium having a second size, the second size being larger than the first size.

21. An image recording apparatus comprising:

an image forming section that forms images;

a primary medium onto which said images are transferred from said image forming section;

a medium cassette that holds a stack of print medium;

a remaining-medium detector that detects remaining print medium held in said medium cassette;

a transfer section configured to transfer the images from said primary medium to the print medium fed from said medium cassette;

a controller that controls a timing at which said image forming section forms the images, the timing being changed in accordance with the remaining print medium; and a timing adjusting section provided between said medium cassette and said transfer section, wherein said controller causes said timing adjusting section to hold the recording medium that is fed from said medium cassette, and to feed the recording medium to said transfer section in timed relation with image formation on said primary medium, thereby transferring an image onto the primary medium at said transfer section.

22. The image recording apparatus of claim 21, wherein said controller causes said image forming section to form the images at first timings when said medium cassette holds the print medium of more than a reference value;

said controller causes said image forming section to form the images at second timings when said medium cassette holds the print medium equal to or less than the reference value; and the second timings are delayed relative to the first timings so that the images are formed at greater distance intervals on the primary medium when the images are formed at the second timings than when the images are formed at the first timings.

23. The image recording apparatus of claim 21, wherein said controller changes the timing when said medium cassette holds the print medium of equal to or less than a reference value, the images being after said controller has determined that the medium cassette holds the print medium.

24. The image recording apparatus of claim 21, wherein said medium cassette is one of a plurality of medium cassettes each of which has the remaining-medium detector;

when a first medium cassette of the plurality of medium cassettes holds the print medium more than a reference value during a printing job, said controller feeds the print medium from the first medium cassette to said transfer section; and when the first medium cassette becomes empty of the print medium in the middle of the printing job, said controller feeds the print medium from a second medium cassette of the plurality of medium cassettes to said transfer section instead of the first medium cassette, the second medium cassette holding a stack of print medium therein.

25. The image recording apparatus of claim 21, wherein said controller causes said image forming section to form the images at different distance intervals in accordance with the print medium remaining in the medium cassette.

26. The image recording apparatus of claim 21, further comprising a display that indicates that the print medium remaining in said medium cassette is less than a reference value.

27. The image recording apparatus of claim 21, wherein the primary medium is a transfer belt.

28. The image recording apparatus of claim 21, wherein the primary medium is a transfer drum.

29. The image recording apparatus of claim 21, wherein said medium cassette includes a medium-holding member that holds the stack of the print medium thereon and takes up a different position in accordance with the print medium remaining in the medium cassette, wherein the remaining medium detector detects the print medium held in the medium cassette in terms of a position of the medium-holding member.

* * * * *

UNITED STATES PATENT AND TRADEMARK OFFICE

CERTIFICATE OF CORRECTION

PATENT NO. : 6,834,166 B2
APPLICATION NO. : 10/335358
DATED : December 21, 2004
INVENTOR(S) : Shuichi Fujikura It is certified that error appears in the above-identified patent and that said Letters Patent is hereby corrected as shown below:

Column 19, lines 59 and 60:

The word “recording” should be replaced with -- print --;

At column 20, line 3:

The word “primary” should be replaced with -- print --.

Signed and Sealed this

Twenty-ninth Day of January, 2008

JON W. DUDAS
*Director of the United States Patent and Trademark Office*